US012577868B2

(12) United States Patent
Livescu et al.

(10) Patent No.: US 12,577,868 B2
(45) Date of Patent: Mar. 17, 2026

(54) THERMAL CONDUCTIVITY MEASUREMENTS FOR OPTIMIZING GEOTHERMAL FIELD CONSTRUCTION

(71) Applicant: Bedrock Energy, Inc., Los Angeles, CA (US)

(72) Inventors: Silviu Livescu, Austin, TX (US); Javad Gatabi, San Marcos, TX (US); Rio Whyte, Austin, TX (US); Kyle Clark, Georgetown, TX (US); Tanner William Palmer, Austin, TX (US)

(73) Assignee: Bedrock Energy, Inc., Los Angeles, CA (US)

( * ) Notice: Subject to any disclaimer, the term of this patent is extended or adjusted under 35 U.S.C. 154(b) by 148 days.

(21) Appl. No.: 18/645,137

(22) Filed: Apr. 24, 2024

(65) Prior Publication Data

US 2024/0368977 A1 Nov. 7, 2024

Related U.S. Application Data

(60) Provisional application No. 63/464,123, filed on May 4, 2023.

(51) Int. Cl.

| | |
|---|---|
| ***E21B 44/00*** | (2006.01) |
| ***E21B 4/04*** | (2006.01) |
| ***E21B 17/20*** | (2006.01) |
| ***E21B 19/22*** | (2006.01) |

(52) U.S. Cl.
CPC ..... *E21B 44/00* (2013.01); *E21B 4/04* (2013.01); *E21B 17/206* (2013.01); *E21B 19/22* (2013.01)

(58) Field of Classification Search
CPC ..... E21B 44/00; E21B 4/04; E21B 17/206; E21B 19/22
See application file for complete search history.

(56) References Cited

U.S. PATENT DOCUMENTS

2024/0426211 A1* 12/2024 Shakirov ..... E21B 49/005

FOREIGN PATENT DOCUMENTS

WO WO-2016160021 A1 * 10/2016 ..... G01V 9/00

* cited by examiner

*Primary Examiner* — Dany E Akakpo
(74) *Attorney, Agent, or Firm* — Morgan, Lewis & Bockius LLP

(57) ABSTRACT

A system collects a plurality of drill cuttings from a subsurface of a geothermal borehole while drilling the borehole. The system obtains a plurality of thermal conductivity values for the plurality of drill cuttings. The system determines, using the plurality of thermal conductivity values, thermal performance data of the geothermal borehole. In accordance with a determination that the thermal performance data of the geothermal borehole meets or exceeds a threshold value, the system updates, according to the thermal performance data, one or more drilling parameters to one or more updated drilling parameters and controls the drilling of the geothermal borehole according to the one or more updated drilling parameters.

20 Claims, 25 Drawing Sheets

| | Surface Data | Downhole data |
|---|---|---|
| **Mud Data** | Pit volume<br>Mud temperature<br>Mud pressure<br>Mud weight<br>Pump strokes | N/A |
| **Well Data** | Temperature<br>Pressure<br>Gas measurements | Temperature<br>Pressure |
| **Directional Data** | | Inclination<br>Azimuth |
| **Drilling Mechanics** | RPM<br>Weight on bit<br>Torque<br>Bending moment<br>Rotary torque<br>Hook load<br>Rate of penetration | RPM<br>Weight on bit<br>Torque on bit<br>Bending moment<br>Downhole vibration |
| **Geological data** | Cutting analysis | Density<br>Porosity<br>Resistivity<br>Gamma |

Figure 5E

THERMAL CONDUCTIVITY MEASUREMENTS FOR OPTIMIZING GEOTHERMAL FIELD CONSTRUCTION

RELATED APPLICATIONS

This application claims priority to U.S. Provisional Patent Application No. 63/464,123, filed May 4, 2023, titled "Systems and Methods for Geothermal Borehole Drilling," which is incorporated by reference herein in its entirety.

This application is related to U.S. patent application Ser. No. 18/645,113, filed Apr. 24, 2024, titled "Electrical Drilling Systems and Methods for Geothermal Field Construction," which is incorporated by reference herein in its entirety.

This application is also related to the following applications, all of which are incorporated by reference herein in their entireties:

(i) U.S. patent application Ser. No. 17/835,905, filed Jun. 8, 2022, titled "Geothermal Well Construction for Heating and Cooling Operations," now U.S. Pat. No. 11,520,313, issued on Dec. 6, 2022; and (ii) U.S. patent application Ser. No. 17/976,445, filed Oct. 28, 2022, titled "Coiled Tubing Drilling for Geothermal Heating and Cooling Applications."

TECHNICAL FIELD

The disclosed implementations relate generally to geothermal energy systems, and more specifically to systems, methods, and devices for constructing geothermal fields.

BACKGROUND

Geothermal energy is a renewable resource that harnesses the Earth's heat. Just a few feet below the surface, the Earth maintains a near-constant temperature, in contrast to the summer and winter extremes of the ambient air above ground.

Installing a geothermal heating and cooling system (GHCS) (also referred herein as a geothermal system) generally involves drilling one or more geothermal wells (e.g., geothermal boreholes) horizontally or vertically, depending on the characteristics of the site. A looped pipe is constructed from the geothermal wells, and heat is transferred between the building (e.g., a residential or commercial building) and the earth using fluid circulated through the looped pipes.

SUMMARY

Current GHCS installations have several drawbacks. First, these installations generally do not take into account surface or subsurface conditions of the site in which the geothermal system would be installed. Instead, standard-sized geothermal wells (e.g., geothermal boreholes) are usually constructed, with depths, lengths, and spacings that are pre-determined based on prior rule-of-thumb experience of the drillers. Second, current residential geothermal systems tend to have fairly shallow well depths (e.g., around 20 feet deep for horizontal geothermal loops) with a large amount of pipes buried horizontally. For example, a typical 2,000-square-foot home uses around 1,500 to 1,800 feet of pipes. Larger buildings, such as industrial, commercial or multi-story residential, would require impractical lengths of horizontal pipes.

Drilling geothermal wells without proper planning and engineering design can lead to non-optimal performance of the geothermal systems, both short-term and in the long run. This directly translates into higher operating costs and unreliable heating and cooling systems for the building owners. Furthermore, the current installation model for residential geothermal systems, which utilizes shallow geothermal wells and large horizontal areas, is not scalable for buildings that are bigger in size (e.g., commercial buildings), have higher energy loads, and/or are located in areas of higher density. For example, a commercial building located in a city may require multiple deep geothermal boreholes, constructed vertically, to be drilled for a geothermal system to properly work.

Current drilling technologies for geothermal and hydrocarbon well construction are divided between (Category A) small drilling rigs for shallow water or geothermal wells (e.g., 100 to 400 feet long vertical (e.g., deep) wells, and (Category B) large drilling rigs for deep oil and gas and conventional geothermal wells (e.g., 10,000 to 30,000 feet long vertical wells). No off-the-shelf drilling rig exists commercially for mid-range-length wells that are between 500 and 10,000 feet deep. Therefore, no off-the-shelf drilling rig has been developed for this range, leaving a technology gap between Categories A and B. While shallow water well drilling rigs (Category A) are small and portable enough to be transported and operated in high-density urban areas, they do not go very deep and are not very fast. The deep oil and gas rigs (Category B) are fast and powerful, but also large and heavy, and are meant to operate in remote areas far from urban/suburban development. This leaves a gap for fast and strong, yet compact and portable drilling rigs that can operate in urban/suburban/rural areas.

In addition to the technology gap for mid-range length geothermal wells, several constraints exist when it comes to constructing geothermal fields in urban (e.g., high-density), suburban, and, or commercial areas. These include space limitations, weight limitations (e.g., the drill rig needs to be transported to and from the construction site via paved concrete roads), and noise generated during well construction. There is also a need for improved systems, methods, and devices for drilling mid-range depth geothermal wells (e.g., about 500-10,000 feet deep, 500-5,000 feet deep, or 500-2,500 feet deep) in urban (e.g., high-density), suburban, and, or commercial areas.

Accordingly, there is a need for improved systems, methods, and devices for geothermal well construction, particularly for mid-range depth geothermal wells.

The present disclosure describes improved systems, devices, and methods for geothermal field construction. As used herein, a geothermal field refers to a set of (e.g., one or more) boreholes, a set of (e.g., one or more) geothermal loops connected to a building, and the rock volume surrounding the set of geothermal loops. In some embodiments, a geothermal field can refer to the entire set of boreholes and geothermal loops connected to a building, and the rock volume surrounding all the geothermal loops. In this disclosure, the term "geothermal field" is used interchangeably with the term "geo-field." The term "geothermal loop" is used interchangeably with the term "geo-loop."

Some embodiments of the present disclosure are directed to a novel downhole electrical resistivity tomography (ERT) system that acquires ERT data of subsurface structures (e.g., rocks) during drilling. While the use of ERT has been demonstrated in applications such as soil mapping and subsurface characterization, obtaining real time ERT measurements data during drilling remains a challenge due to the dynamics of the drilling process and variations in subsurface structures encountered during drilling. This can in turn influence the quality or signal-to-noise ratio (SNR) of the acquired data. As disclosed, the downhole ERT system adaptively tunes the impedances between the electrodes and the under-test material by controlling an electrolytic conductivity of the drilling fluid to collect data with optimum signal-to-noise ratio. For example, in some embodiments, the electrolytic conductivity of the drilling fluid can be dynamically adjusted by adding impurities to the drilling fluid.

Some embodiments of the present disclosure are directed to electrical drilling systems and methods for geothermal field construction. Current drilling technologies are mostly hydraulics based, and the science and engineering of the drilling mud can be complex. Not only that, hydraulics based drilling requires the use of large volumes of drilling fluids and are prone to lost returns, especially if the hole is drilled through natural factures or thief zones. The lost fluid is an additional expense and complicates the operational logistics due to the large volumes of fluids. It can also be cumbersome to store and/or dispose drilling mud in urban and commercial settings. The problems associated with hydraulics based drilling technology can be overcome using electrical based drilling technology. Electrical drilling is not employed in the oil and gas industry because huge power losses can be incurred when transmitting electricity across cables that are over 10,000 feet long. It is also not practical to have electrical cables of these lengths to transmit power to the drill bit. These challenges associated with electrical drilling technologies in deep oil and gas can be overcome in the case of drilling mid-range-length wells that are between 500 and 3,000 feet deep, where power losses are not as high.

As disclosed, in some embodiments, an electrical bottomhole assembly (BHA) can include any combination of an electrical drill bit, an electrical drilling motor, an electrical directional tool, and any other electrical tools such as hammers, tractors, and sensory sub-assemblies. In some embodiments, a coiled tubing string can be used as a path of electrical conductivity, to transfer electrical power from a power source to an electrical drilling motor. Electrical drilling technologies emit less greenhouse gases, especially if the electricity is produced from renewable energy. Electrical BHAs are also more environmentally friendly compared to gas- and diesel-powered BHAs.

Some embodiments of the present disclosure are directed to measuring thermal conductivities of rocks (e.g., at both surface and subsurface) at a geothermal field site and inputting the data into a model, and optimizing the drilling conditions based on the measured data and model output.

The present disclosure advantageously improves upon current geothermal well construction processes. For example, data collected by ERT and thermal conductivity measurements can be fed into the model to provide extensive insights into subsurface geological properties and enable more efficient drilling operations, consequently reducing overall drilling costs and enhancing the financial viability of building heating and cooling projects. The use of electrical drilling techniques emits less greenhouse gases, is more environmentally friendly, and potentially reduces the size of the bottomhole assembly (e.g., because an electrical motor can be lighter and more compact to a hydraulics motor)

The systems, methods, and devices of this disclosure each have several innovative aspects, no single one of which is solely responsible for the desirable attributes disclosed herein.

In accordance with some embodiments, a system for constructing geothermal fields includes a coiled tubing (CT) string, a power source, and an electrically activated bottomhole assembly (BHA) coupled to the CT string. The electrically activated BHA includes an electric motor and a drill bit. The system also includes one or more processors and memory coupled to the one or more processors. The memory stores instructions that, when executed by the one or more processors, cause the system to deploy the CT string from a surface into a subsurface to drill (e.g., construct) a geothermal borehole. During the drilling, the system transfers electrical power from the power source to the electric motor via at least a first portion of the CT string, and transfers electrical current from the electric motor to the electric power source via an electrical conductor that is different from the at least the first portion of the CT string.

In some embodiments, the CT string is a concentric CT string comprising an inner portion surrounded by an outer portion. The first portion of the CT string is the inner portion and the electrical conductor is the outer portion.

In accordance with some embodiments, a system for constructing geothermal fields comprises a coiled tubing (CT) string and an electrical resistivity tomography (ERT) device coupled to the CT string. The ERT device includes a plurality of electrodes. The system includes one or more processors and memory coupled to the one or more processors. The memory stores instructions that, when executed by the one or more processors, cause the system to deploy the CT string from a surface into a subsurface to drill (construct) a geothermal borehole. The system obtains, in real time during the drilling, electrical resistivity data of the subsurface via the plurality of electrodes of the ERT device. The system adjusts, in real-time according to the obtained electrical resistivity data, an electrolytic conductivity of a drilling fluid that is pumped through the CT string (e.g., so as to improve a quality of the obtained electrical resistivity data).

In accordance with some embodiments, method for constructing geothermal fields comprises, while drilling a geothermal borehole (e.g., using one or more drilling parameters), collecting a plurality of drill cuttings from a subsurface of the geothermal borehole. The method includes obtaining a plurality of thermal conductivity values for the plurality of drill cuttings. The method includes determining, using the plurality of thermal conductivity values, thermal performance data of the geothermal borehole. The method includes, in accordance with a determination that the thermal performance data meets or exceeds a threshold value, updating, according to the thermal performance data, one or more drilling parameters to one or more updated drilling parameters, and controlling the drilling of the geothermal borehole according to the one or more updated drilling parameters.

In some embodiments, obtaining the plurality of thermal conductivity values for the plurality of drill cuttings includes subjecting a drill cutting to a pressure between a rock fracturing pressure of the drill cutting and a hydrostatic pressure corresponding to a respective subsurface depth from which the drill cutting is collected.

In some embodiments, the thermal performance data of the geothermal borehole is obtained by inputting the plurality of thermal conductivity values into a geothermal model. In some embodiments, the method includes updating the model to include associations (e.g., correlations, relationships) between a respective thermal conductivity value and the corresponding (subsurface) depth information of the geothermal borehole.

In accordance with some embodiments, a computer system includes one or more processors, memory, and one or more programs stored in the memory. The programs are configured for execution by the one or more processors. The one or more programs include instructions for performing any of the methods described herein.

In accordance with some embodiments, a non-transitory computer-readable storage medium stores one or more programs configured for execution by a computer system having one or more processors and memory. The one or more programs include instructions for performing any of the methods described herein.

Note that the various embodiments described above can be combined with any other embodiments described herein. The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes and may not have been selected to delineate or circumscribe the inventive subject matter.

BRIEF DESCRIPTION OF THE DRAWINGS

FIG. 5E illustrates exemplary types of surface data and downhole data that are collected by sensors in accordance with some embodiments.

Reference will now be made to implementations, examples of which are illustrated in the accompanying drawings. In the following description, numerous specific details are set forth in order to provide a thorough understanding of the present invention. However, it will be apparent to one of ordinary skill in the art that the present invention may be practiced without requiring these specific details.

DESCRIPTION OF IMPLEMENTATIONS

Some methods, devices, and systems disclosed in the present specification improve upon geothermal heating and cooling system (GHCS) operations by providing an integrated workflow that combines data modeling, hardware components, and a workflow for planning, executing, and/or optimizing a GHCS installation operation.

In accordance with some aspects of the present disclosure, the GHCS operation includes drilling one or more geothermal wells (e.g., boreholes). GHCS drilling employ various technologies and methods to drill and construct geothermal boreholes in urban, suburban, and rural areas. Methods of drilling geothermal boreholes include joint pipe drilling and CT drilling. Performing an optimal geothermal drilling operation involves modeling design before the operation, using downhole parameters such as a borehole size and length, mechanical friction forces, tensile forces, pumping rates, soil and rock properties, pressure and/or temperature. Some aspects of the present disclosure describe using surface and subsurface (e.g., underground) sensors for acquiring data such as pressure, temperature, depth correlation and azimuth, rock hardness, pumping rates, etc., for adjusting the pre-operation design in real time while drilling. Some aspects of the present disclosure describe using the same model after the GHCS drilling and construction operation is finished, to monitor the geothermal loop inlet and outlet temperature and enthalpy, the indoor temperature, and/or the coefficient of performance of the heat pump in real time, and to adjust the pump rate to maintain an optimal heating and cooling performance.

In this disclosure, a "geothermal field" is also referred to as a "geo-field." Both of these terms have the same meaning.

In this disclosure, a "geothermal loop" is also referred to as a "geo-loop." Both of these terms have the same meaning.

Figure 1:
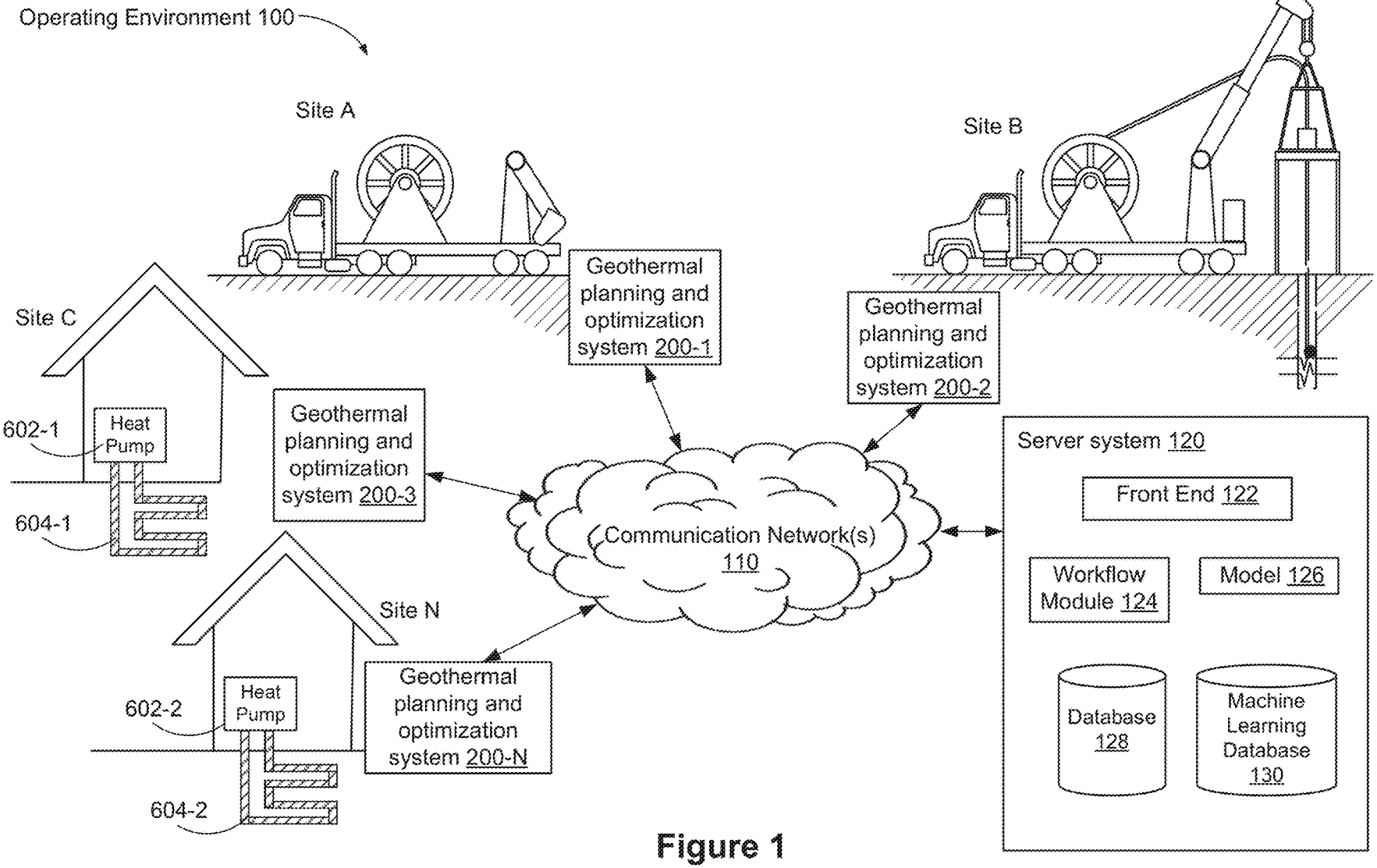
FIG. 1 illustrates an operating environment in accordance with some embodiments.

FIG. 1 illustrates an operating environment 100 in accordance with some embodiments. In some embodiments, the operating environment 100 includes one or more geothermal planning and optimization systems 200 (e.g., a computer system, a computing device, or an electronic device). In the example of FIG. 1, each of the systems 200-1, 200-2, 200-3, and 200-N is located at a respective (e.g., distinct) site (e.g., Site A, Site B, Site C, Site N), corresponding to a respective (e.g., distinct) city, state, or country.

In some embodiments, each of the geothermal planning and optimization systems 200 is configured to be operable at various phases (e.g., all phases, all stages, or a subset thereof) of a GHCS operation. The phases can include a pre-construction phase, a construction phase, and a post-construction phase. For example, in FIG. 1, the geothermal planning and optimization system 200-1 located in Site A corresponds to the pre-construction phase. The system 200-2 located in Site B corresponds to the construction phase. The systems 200-3 and 200-N, in Site C and Site N respectively, correspond to the post-construction phase.

In some embodiments, the geothermal planning and optimization system 200 is communicatively coupled through communication network(s) 110 to a server system 120.

In some embodiments, the server system 120 includes a front end server 122 that facilitates communication between the server system 120 and the geothermal planning and optimization system 200. The front end server 122 is configured to receive information from the geothermal planning and optimization system 200. For example, during the planning (e.g., pre-construction) phase for a geothermal borehole construction project at Site A, the front end server 122 can receive (e.g., in real-time), from the geothermal planning and optimization system 200-1, information such as building size, site information, and/or data regarding rock type found at Site A. As another example, during the construction of a geothermal borehole at Site B, the front end server 122 can receive (e.g., in real-time) from the geothermal planning and optimization system 200-2 information such as sensor data collected by one or more sensors of a drilling rig that is performing the borehole construction at Site B. As another example, the front end server 122 can receive (e.g., in real-time) from the geothermal planning and optimization system 200-3 information such as a fluid flow rate, a heat pump coefficient of performance (COP) for heating, and/or a heat pump energy efficiency ratio (EER) for cooling, corresponding to a geothermal loop 604-1 at Site C.

In some embodiments, the front end server 122 is configured to send information to the one or more geothermal planning and optimization systems 200. For example, the front end server 122 can send operational parameters (e.g., drilling depth, diameter, and/or direction) to the geothermal planning and optimization system 200-1, to facilitate drilling of the geothermal borehole at Site A. As another example, in response to receiving the sensor data from the geothermal planning and optimization system 200-2, the front end server 122 can send updated operational parameters to the geothermal planning and optimization system 200-2, to control (e.g., optimize) the dimensions of the geothermal borehole that is being constructed art Site B. As another example, in response to receiving data associated with the geothermal loop 604-1, the front end server 122 can send to the geothermal planning and optimization system 200-3 information such as a desired flow rate for the working fluid, so as to optimize the operation of the geothermal loop 604-1.

In some embodiments, the server system 120 includes a workflow module 124 for providing an integrated workflow 628 corresponding a geothermal heating and cooling system operation. Details of the workflow module 124 are described in FIGS. 2 and 3, and 6A to 6C, as well as U.S. patent application Ser. No. 17/835,905 and U.S. patent application Ser. No. 17/976,445, both of which are incorporated by reference herein in their entireties.

In some embodiments, the server system 120 includes a model 126 (e.g., a physics-based model, a mathematical-based model, a data-driven model, a machine learning algorithm) for modeling the heating and cooling loads of the building, the heat pump, and the GHCS well (e.g., geothermal borehole(s)) sizes and lengths. Details of the model 126 are discussed with reference to FIGS. 2 and 3.

Figure 3:
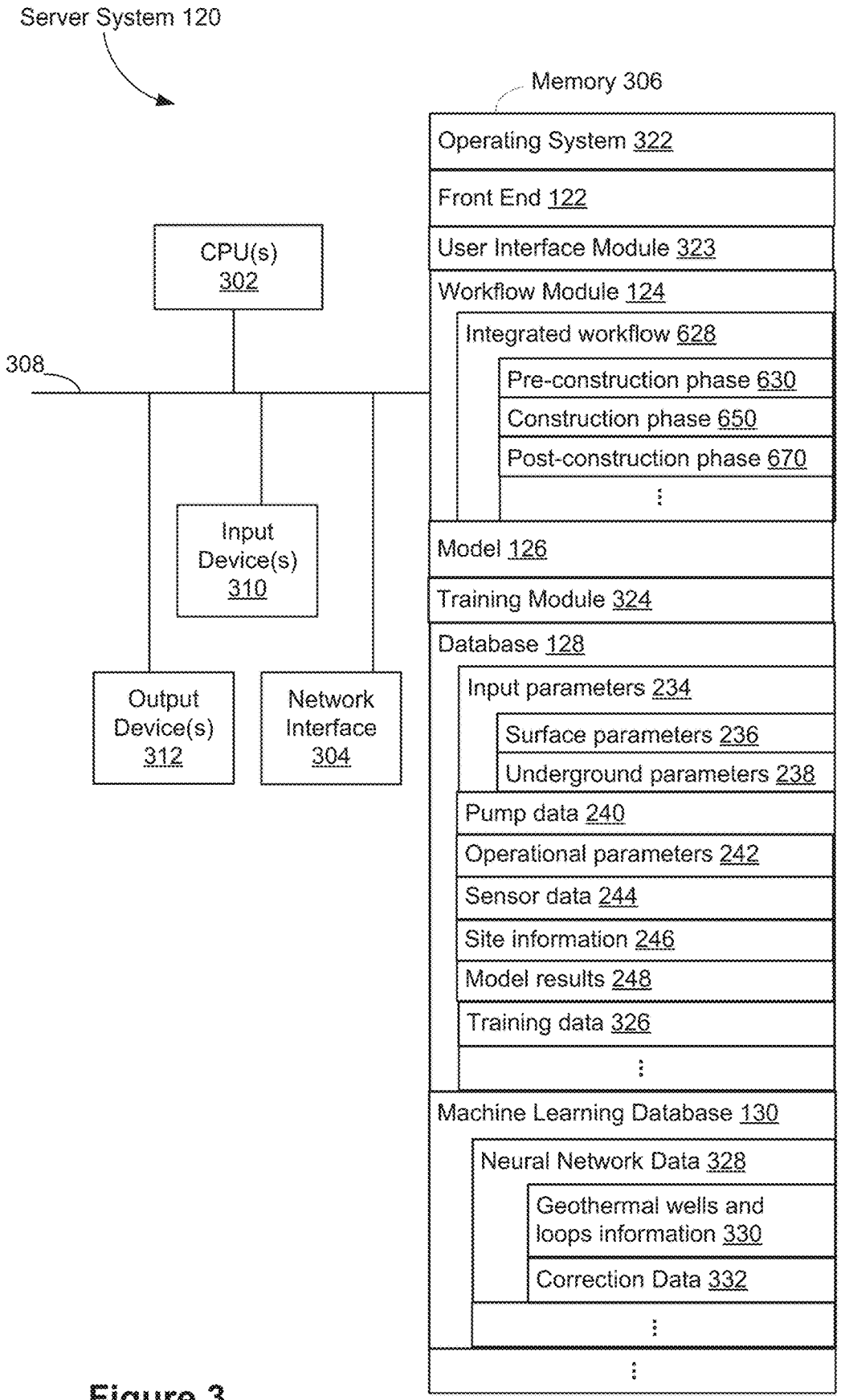
FIG. 3 is a block diagram illustrating a server system, in accordance with some embodiments.

In some embodiments, the server system 120 includes a database 128, which is described with respect to FIG. 3.

In some embodiments, the server system 120 includes a machine learning database 130 that stores machine learning information. In some embodiments, the machine learning database 130 is a distributed database. In some embodiments, the machine learning database 130 includes a deep neural network database. In some embodiments, the machine learning database 130 includes supervised training and/or reinforcement training databases.

Figure 2:
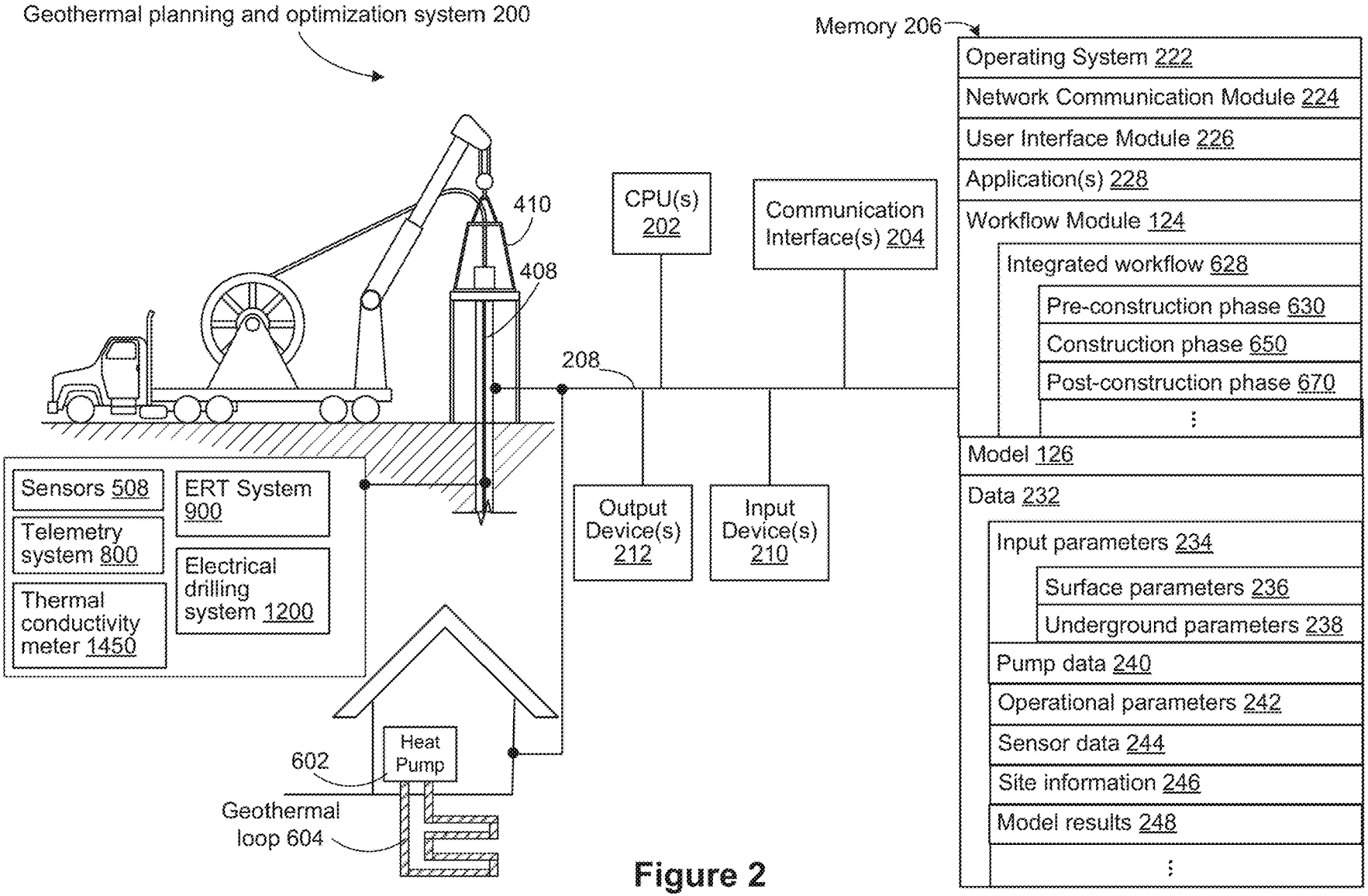
FIG. 2 illustrates a block diagram of a geothermal planning and optimization system according to some embodiments.

FIG. 2 illustrates a block diagram of a geothermal planning and optimization system 200 according to some embodiments.

The system 200 typically includes one or more processors (e.g., processing units, processing circuitry, electrical processing circuitry, hydraulic circuitry, signal processing circuitry, or CPUs) 202, one or more network or other communication interfaces 204, memory 206, and one or more communication buses 208 for interconnecting these components. In some embodiments, the communication buses 208 include circuitry (sometimes called a chipset) that interconnects and controls communications between system components.

In some embodiments, the system 200 includes (or is communicatively connected to) one or more sensors 508 that are positioned on a drill bit 502 of a CT 408 (or a CT string) and/or a joint pipe 422, the details of which are described in FIGS. 4, 5, and 6.

In some embodiments, the system 200 includes a CT 408 and a CT injector 410.

In some embodiments, the system 200 includes (or is communicatively connected to) a telemetry system 800. Details of the telemetry system 800 are described in FIGS. 8A to 8D.

In some embodiments, the system 200 includes (or is communicatively connected to) an electrical resistivity tomography (ERT) system 900. Details of the ERT system 900 are described in FIGS. 9, 10, and 11.

In some embodiments, the system 200 includes (or is communicatively connected to) an electrical drilling system 1200 (e.g., electrical bottomhole assembly). Details of the electrical drilling system 1200 are described in FIG. 12.

In some embodiments, the system 200 includes (or is communicatively connected to) a thermal conductivity meter 1450 for measuring thermal conductivity properties of surface and subsurface structures. Details of the measurements are described with reference to FIGS. 15A to 15D.

In some embodiments, the system 200 is communicatively connected to one or more heat pumps 602 that are operably coupled to one or more respective geothermal loops 604. Details of the heat pump 602 and the geothermal loop are described in FIG. 7.

The system 200 includes one or more input devices 210 that facilitate user input, such as a keyboard, a mouse, a voice-command input unit or microphone, a touch screen display, a touch-sensitive input pad, a gesture capturing camera, or other input buttons or controls. In some embodiments, the system 200 includes one or more cameras or scanners for capturing data. The system 200 also includes one or more output devices 212 that enable presentation of user interfaces and display content, including one or more speakers and/or one or more visual displays.

In some embodiments, the memory 206 includes high-speed random access memory, such as DRAM, SRAM, DDR RAM, or other random access solid state memory devices; and, optionally, includes non-volatile memory, such as one or more magnetic disk storage devices, one or more optical disk storage devices, one or more flash memory devices, or one or more other non-volatile solid state storage devices. In some embodiments, the memory 206 includes one or more storage devices remotely located from one or more processing units 202. The memory 206, or alternatively the non-volatile memory device(s) within the memory 206, includes a non-transitory computer-readable storage medium. In some embodiments, the memory 206 or the computer-readable storage medium of the memory 206 stores the following programs, modules, and data structures, or a subset or superset thereof:

an operating system 222, including procedures for handling various basic system services and for performing hardware dependent tasks;

a communications module 224, which is used for connecting the system 200 to other systems, computers and devices via the one or more communication interfaces 204 (wired or wireless), such as the communication network(s) 110, Internet, other wide area networks, local area networks, metropolitan area networks, and so on;

a user interface module 226, which enables presentation of information (e.g., a graphical user interface for application(s) 228, widgets, websites and web pages thereof, and/or audio and/or video content, text, etc.) at the system 200 via one or more output devices 212 (e.g., displays, speakers, etc.);

one or more user applications 228, which are executed by the system 200 (e.g., web or non-web based applications for controlling another system, electronic device, or sensors, or for reviewing data captured by such devices);

a workflow module 124, which provides an integrated workflow 628 corresponding a GHCS operation;

a model 126, which models the heating and cooling loads of the building, the heat pump, and the GHCS well (e.g., geothermal borehole(s)) sizes and lengths); and data 232, including:

input parameters 234. In some embodiments, the input parameters 234 include surface parameters 236. The surface parameters 236 include: building size, building type (e.g., wall material and insulation; roof type; number, size, and orientation of windows; ventilation system; etc.), location, outdoor temperature, heat pump size, heat pump type, and/or inlet/outlet temperatures of the geothermal loop. In some embodiments, the input parameters 234 include underground parameters 238. The underground parameters 238 include: fluid type (e.g., density and/or viscosity, and thermal conductivity), geothermal loop roughness, inlet temperatures of the geothermal loop(s), geothermal loop length and/or depth, size (e.g., diameter), and trajectory (e.g., vertical, horizontal, inclined, and/or deviated), geothermal loop material/heat transfer coefficient, soil and/or rock type and properties, aquifer depth and height, grout/cement/casing heat transfer coefficients, and geothermal working fluid flow rate;

pump data 240, including manufacturer heat pump COP (for heating) and/or EER (for cooling) and/or calculated heat pump COP and/or EER (e.g., during borehole construction or during operation of a geothermal loop);

operational parameters 242, including drilling depth(s), drilling diameter(s), and/or drilling direction(s);

sensor data 244. In some embodiments, the sensor data 244 is collected automatically and/or in real time. In some embodiments, the sensor data 244 is collected directly (e.g., by sensors 508 or sensors 510) or by indirect measurements. In some embodiments, the sensor data 244 includes surface data and/or downhole data, as illustrated in FIG. 5E;

site information 246, including geographical location(s) of geothermal borehole(s), rock conditions, heat pump(s), geothermal loop(s) and their inlet and outlet temperatures, working fluid type(s), and/or working fluid flow rates; and model results 248 generated by the model 126.

In some embodiments, the integrated workflow 628 includes a combination of one or more workflows, each corresponding to a respective phase of a geothermal heating and cooling operation (e.g., a geothermal project). The integrated workflow 628 can include a combination of: a pre-construction phase workflow 630, a construction phase workflow 650, and a post-construction phase workflow 670. In some embodiments, each of the workflows 630, 650, and 670 can be executed as a standalone workflow. Further details of the workflows 630, 650, and 670 are discussed in FIGS. 6A to 6C, as well as in U.S. patent application Ser. No. 17/835,905 and U.S. patent application Ser. No. 17/976,445, both of which are incorporated by reference in their entireties.

In some embodiments, the model 126 comprises a physics-based model, a mathematical-based model, a data-driven model, and/or a machine learning algorithm. In some embodiments during a pre-construction phase, the model 126 uses data 232, such as input parameter(s) 234, a heat pump COP for heating, and/or a heat pump EER for cooling, to predict (e.g., estimate) the length and/or depth of the borehole(s) to be drilled and/or estimate one or more locations for the boreholes. The model 126 generates operational parameters 242 for constructing a geothermal borehole. In some embodiments, during a construction phase, the model 126 uses sensor data 244 (e.g., collected in real time using sensors 508 and/or sensors 510) to further refine and/or optimize the operational parameters 242. In some embodiments, during a post-construction phase, the model 126 uses inputs such as a surface air temperature, a building size, a heat pump COP for heating, and/or a heat pump EER for cooling, for determining heat exchange parameters at a geothermal loop and determining an optimized flow rate of the fluid in the geothermal loop.

In some embodiments, the model 126 comprises a subsurface fluid transport and heat transfer model. The model 126 allows a user to automatedly engineer an entire subsurface system (e.g., engineer the number, size(s), length(s) of geothermal wells (e.g., boreholes), and the distance between wells) specifically designed for each building.

In some embodiments, the model 126 includes a surface sub-model and an underground sub-model. The surface sub-model solves energy balance equations for the building and heat pump(s). For example, the surface sub-model uses a subset of the surface parameters 236 and generates, as outputs, the heat pump efficiency and the geothermal working fluid flow rate. The underground sub-model solves mass, momentum, and energy conservation equations in the geothermal loop(s) and radial diffusivity equation(s) in the underground rocks around the geothermal borehole(s). The underground sub-model uses a subset of the underground parameters 238 and generates (e.g., outputs) an outlet temperature of the geothermal loop. In some embodiments, the model 126 couples the surface sub-model and the underground sub-model and solves them together. In this instance, the model 126 uses a subset of the surface parameters 236 and the underground parameters 238 as inputs, and calculates an optimum heat pump efficiency by adjusting the geothermal working fluid flow rate. The unknowns in the model 126 can include: underground heat transfer coefficients in the rocks, aquifer, and grout/cement (e.g., the grout/cement thickness may vary along the borehole length). Thus, inlet/outlet temperatures of the geothermal loops and geothermal working fluid flow rates (e.g., site information 246) are measured over time and data sets (e.g., training data training data 326) are built to predict the underground heat transfer coefficients using non-linear least square solvers such as the gradient-based Levenberg-Marquardt algorithm. This, in turn, allows for adjusting the geothermal working fluid flow rates for continuously optimal heat pump efficiencies (e.g., during the day, at night or every day of the year).

In some embodiments, the model 126 is capable of simulating any number of boreholes and geothermal loops using data from multiple distinct locations with varying geology, rock lithology, subsurface pressure, temperature, and other characteristics. Because of the large volume of spatially distributed data points utilized in its development and its capacity to be refined in real time by leveraging site-specific data, the model 126 represents a substantial advancement over the current state-of-the-art models used in the geothermal drilling industry. This allows for optimal drilling (reducing the capital cost) as well as performance (reducing operational cost) of geothermal systems, thereby addressing the two critical barriers preventing adoption of the geothermal systems.

In some embodiments, the model 126 employs distributed data points along a 1,000- to 2,000-feet borehole's geothermal gradient to precisely characterize the thermal behavior along the entire length of the borehole. The model 126 has the capability to account for any arrangement of borehole geometry. There are no limitations on the placement of borehole centers on the grid.

In some embodiments, the model 126 accounts for the thermal interactions between the boreholes arrayed alongside one another in the field (i.e., lateral interaction of borehole heat exchangers)

In some embodiments, the model 126 has the ability to interface with any geothermal drilling device in order to perform on-the-fly calculations to optimize the drilling process. The model 126 is flexible to allow refinement and updating parameters in real time when coupled with sensors that provide real-time subsurface field data. The model 126 has the capacity to enhance heat pump model predictions (and, by extension, building energy model predictions) with the provision of dynamic ground source temperature distribution data.

Although FIG. 2 shows a system 200, FIG. 2 is intended more as a functional description of the various features that may be present rather than as a structural schematic of the implementations described herein. In practice, and as recognized by those of ordinary skill in the art, items shown separately could be combined and some items could be separated.

Each of the above identified executable modules, applications, or sets of procedures may be stored in one or more of the memory devices, and corresponds to a set of instructions for performing a function described above. The above identified modules or programs (i.e., sets of instructions) need not be implemented as separate software programs, procedures, or modules, and thus various subsets of these modules may be combined or otherwise re-arranged in various implementations. In some embodiments, the memory 206 stores a subset of the modules and data structures identified above. Furthermore, the memory 206 may store additional modules or data structures not described above (e.g., module(s) for machine learning and/or training models). In some embodiments, a subset of the programs, modules, and/or data stored in the memory 206 can be stored on and executed by server system 120.

FIG. 3 is a block diagram illustrating a server system 120, in accordance with some embodiments.

The server system 120 includes one or more processors 302 (e.g., processing units of CPU(s)), one or more network interfaces 304, memory 306, and one or more communication buses 308 for interconnecting these components (sometimes called a chipset), in accordance with some embodiments.

In some embodiments, the server system 120 includes one or more input devices 310 that facilitate user input, such as a keyboard, a mouse, a voice-command input unit or microphone, a touch screen display, a touch-sensitive input pad, a gesture capturing camera, or other input buttons or controls. In some embodiments, the server system 120 uses a microphone and voice recognition or a camera and gesture recognition to supplement or replace the keyboard. In some embodiments, the server system 120 includes one or more output devices 312 that enable presentation of user interfaces and display content, such as one or more speakers and/or one or more visual displays.

The memory 306 includes high-speed random access memory, such as DRAM, SRAM, DDR RAM, or other random access solid state memory devices; and, in some embodiments, includes non-volatile memory, such as one or more magnetic disk storage devices, one or more optical disk storage devices, one or more flash memory devices, or one or more other non-volatile solid state storage devices. In some embodiments, the memory 306 includes one or more storage devices remotely located from the one or more processors 302. The memory 306, or alternatively the non-volatile memory within the memory 306, includes a non-transitory computer-readable storage medium. In some embodiments, the memory 306, or the non-transitory computer-readable storage medium of the memory 306, stores the following programs, modules, and data structures, or a subset or superset thereof:

- an operating system 322, including procedures for handling various basic system services and for performing hardware dependent tasks;
- a front end 122, which communicatively couples the server system 120 to other devices and/or systems (e.g., the geothermal planning and optimization systems 200-1, 200-2, 200-3, . . . , 200-N) via the network interface(s) 304 (wired or wireless) and one or more networks, such as communication network(s) 110, the Internet, other wide area networks, local area networks, metropolitan area networks, and so on;
- a user interface module 323, which enables presentation of information (e.g., a graphical user interface for presenting application(s), widgets, websites and web pages thereof, games, audio and/or video content, text, etc.) either at the server system or at a geothermal planning and optimization system 200 (e.g., a computing device);
- a workflow module 124, which provides an integrated workflow 628 corresponding a GHCS operation. In some embodiments, the integrated workflow 628 includes one or more of: a pre-construction phase workflow 630, a construction phase workflow 650, and a post-construction phase workflow 670;
- a model 126;
- a training module 324, which generates and/or trains geothermal planning and optimization models (e.g., model 126) for predicting underground heat transfer coefficient(s). In some embodiments, the training module 324 uses training data 326 to generate and/or train the models. In some embodiments, the training data 326 (e.g., training data sets) is generated from geothermal loop inlet/outlet temperature measurements over time (e.g., one month, six months, one year, five years) and/or geothermal working fluid flow rate measurements over time. In some embodiments, the training data 326 is generated from nearby buildings or from buildings with similar thermal energy loads. In some embodiments, the training module 324 uses non-linear least square solvers such as the gradient-based Levenberg-Marquardt algorithm, for predicting underground heat transfer coefficient(s) for a GHCS site location. This, in turn, allows for adjusting the geothermal working fluid flow rates for continuously optimal heat pump efficiencies (i.e., during the day or at night, every day of the year);

a database 128, which stores data used, collected, and/or created by the workflow module 124, the model 126, and/or the training module 324. The database 128 may store input parameters 234, including surface parameters 236 and/or underground parameters 238, which provide the data used in the model 126, the integrated workflow 628, and/or the workflows 630, 650, and 670. In some embodiments, the database 128 stores pump data 240 of heat pumps that are installed at sites utilizing the system 200. In some embodiments, the database 128 stores operational parameters 242 for constructing geothermal borehole(s), including drilling depth(s), drilling diameter(s), and/or drilling direction(s). In some embodiments, the database 128 stores sensor data 244 that are collected by surface and/or subsurface sensors (e.g., sensors 508 and/or sensors 510) located at various geothermal sites. In some embodiments, the database 128 stores site information 246 of sites equipped with the system 200, including geographical location(s) of geothermal borehole(s), rock conditions, heat pump(s), geothermal loop(s) and their inlet and outlet temperatures, working fluid type(s), and/or working fluid flow rates. In some embodiments, the database 128 stores model results 248 generated by the model 126. In some embodiments, the database 128 stores training data 326. In some embodiments, the database 128 stores the data by site locations. In some embodiments, the database 128 stores the data by a respective identifier of the system(s) 200.

In some embodiments, the memory 306 includes a machine learning database 130 for storing machine learning information. In some embodiments, the machine learning database 130 includes the following datasets or a subset or superset thereof:

neural network data 328, including information corresponding to the operation of one or more neural network(s), including, and not limited to:

geothermal wells and loops information 330, including information (e.g., feature vectors) corresponding to different locations and/or configurations of geothermal wells (e.g., geothermal boreholes) and geothermal loops; and correction data 332 corresponding to the geothermal wells and loops information 330.

In some embodiments, the server system 120 includes a device registration module for registering devices (e.g., the computer device and system) for use with the server system 120.

In some embodiments, the server system 120 includes a notification module (not shown) for generating alerts and/or notifications for users of the geothermal planning and optimization system(s) 200. For example, in some embodiments the model 126 (or the workflow module 124) is stored locally on the system 200 of the user, the server system 120 may generate notifications to alert the user to download the latest version(s) or update(s) to the model.

Each of the above identified elements may be stored in one or more of the memory devices described herein, and corresponds to a set of instructions for performing the functions described above. The above identified modules or programs need not be implemented as separate software programs, procedures, modules or data structures, and thus various subsets of these modules may be combined or otherwise re-arranged in various implementations. In some embodiments, the memory 306 stores a subset of the modules and data structures identified above. In some embodiments, the memory 306 stores additional modules and data structures not described above. In some embodiments, a subset of the programs, modules, and/or data stored in the memory 306 can be stored on and/or executed by the geothermal planning and optimization system 200. In some embodiments, a subset of the programs, modules, and/or data stored in the memory 306 can be stored on and/or executed by system 200.

Figure 4A:
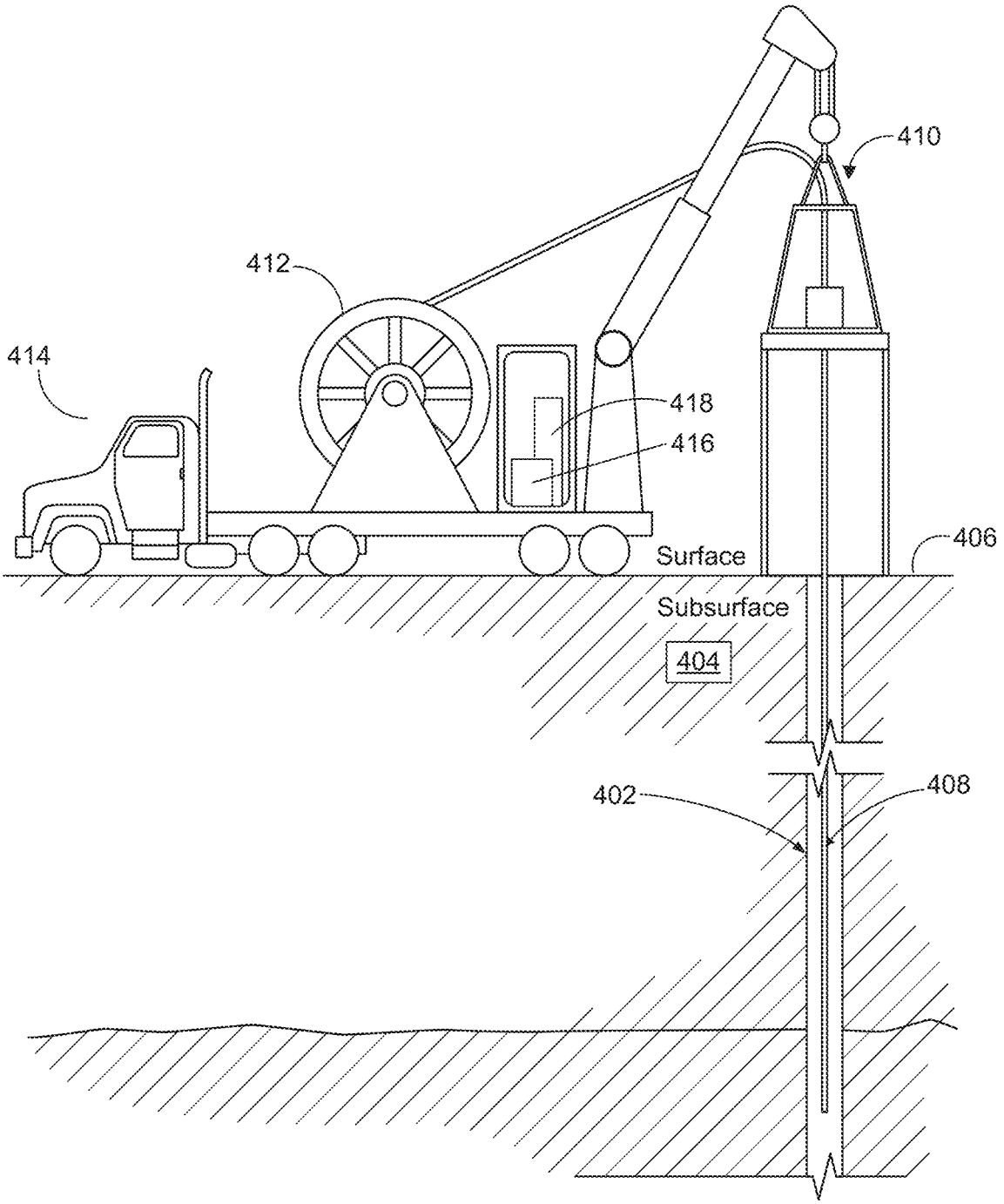
FIGS. 4A and 4B illustrate drilling of a geothermal borehole in accordance with some embodiments.
Figure 4B:
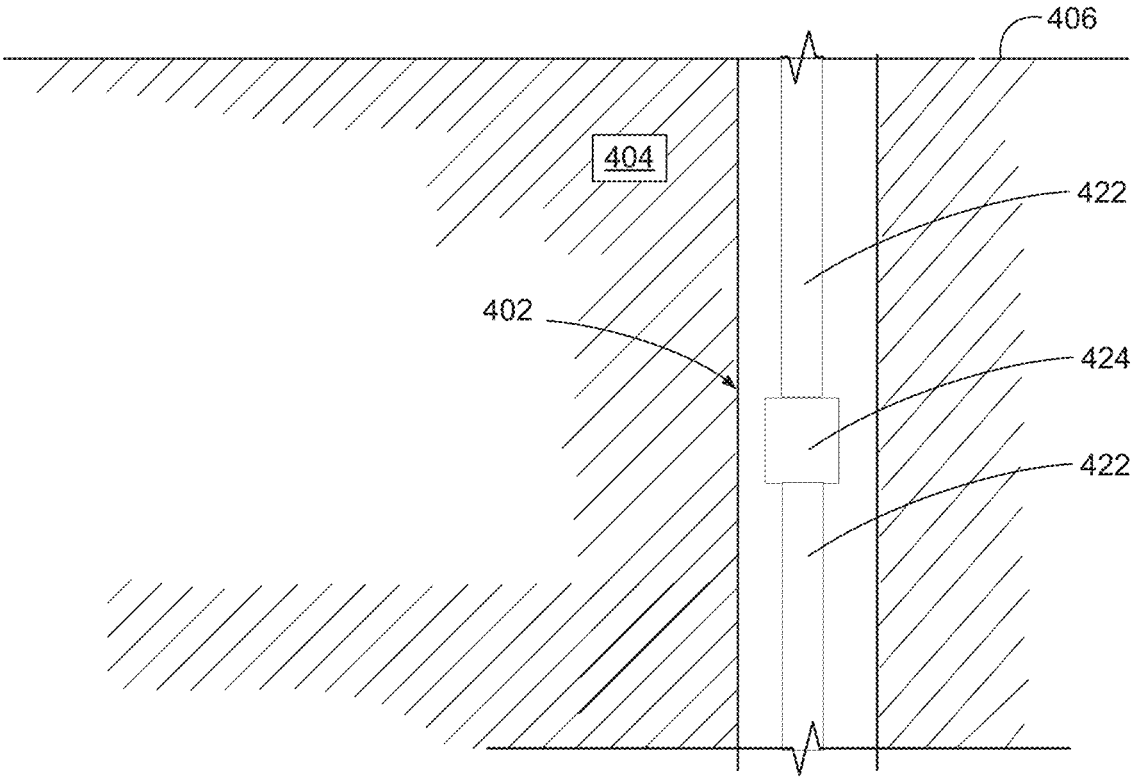

FIGS. 4A and 4B illustrate drilling of a geothermal borehole (e.g., a geothermal well) in accordance with some embodiments. In FIG. 4A, an exemplary geothermal borehole 402 has been (e.g., is being) drilled through the earth 404 from the surface 406. While the geothermal borehole 402 in FIG. 4A is illustrated as a substantially vertical borehole, it might, in practice, have portions that are inclined or horizontally-oriented.

In some embodiments, as illustrated in FIG. 4A, a drill rig comprising CT 408 is used for constructing the geothermal borehole 402. The CT 408 (also referred to as a CT string) is a continuous length of metal or composite tubing with no joints. The CT 408 is sufficiently flexible such that long lengths can be coiled onto a spool and stored on a CT reel 412 that is mounted on a truck 414. During the construction of a geothermal field, the CT 408 can be injected into a geothermal borehole 402 using a CT injector 410. In some embodiments, CT 408 comprises a low-alloy carbon steel tubing. In some embodiments, CT 408 comprises an electrically conductive material. The CT injector 410 injects one end of the CT 408 from the surface into a subsurface to construct a geothermal borehole. In some embodiments, the CT injector 410 is hydraulically powered and provides the surface drive force to run CT 408 underground to drill/construct a geothermal borehole (e.g., a geothermal well), and retrieves CT 408 out of a geothermal borehole after the drilling is completed. In some embodiments, the truck 414 is provided with a radio frequency (RF) power source or generator 416 and motorized equipment 418 of a type known in the art to rotate the reel 412.

In accordance with some embodiments of the present disclosure, the CT reel 412 and/or the CT injector 410 are purposefully re-designed and re-sized for drilling geothermal boreholes with depths of about 1,000 to 2,000 feet. Current drilling technologies for geothermal and hydrocarbon well construction are divided between two categories: (A) small drilling rigs for shallow water or geothermal wells, usually drilling 100- to 400-feet long vertical wells, and (B) large drilling rigs for deep oil & gas and conventional geothermal wells, usually for 10,000 to 30,000 feet long wells. In oil and gas drilling and conventional geothermal drilling, no significant demand has historically existed for mid-range lengths, e.g., between 500 and 10,000 feet. Therefore, no off-the-shelf drilling rig has been developed for this range, leaving a technology gap between (A) and (B). While shallow water well drilling rigs (Category A) are small and portable enough to be transported and operated in high-density urban areas, they do not go very deep and are not very fast. The deep oil and gas rigs (Category B) are fast and powerful, but also large and heavy, and are meant to operate in remote areas far from urban/suburban development. This leaves a gap for fast and strong, yet compact and portable drilling rigs that can operate in urban/suburban/rural areas.

In some embodiments, as illustrated in FIG. 4B, a drill rig comprising one or more joint pipes 422 (e.g., joint drill pipes) are used for constructing the geothermal borehole 402. The joint pipes 422 are straight pipes having a fixed length (e.g., 10 feet long) and that are connected together via one or more tool joints 424 while drilling. For example, rigs for drilling geothermal wells for single-family residential applications (Category A) have joint pipes between 10 and 20 feet long.

Current drilling rigs (Categories A and B) use joint pipes. Drilling down, and then exiting the borehole on the way back up, must slow to a standstill when two joint pipes must be connected together. This repetitive process limits the average drilling speed to about 10-100 feet/hour for the entire well drilling operation. In contrast, with continuous CT drilling, the average drilling speeds can reach 150-200 feet/hour. These faster drilling speeds allow a significant reduction in time and operational costs: for instance, a 400-feet long geothermal well can be drilled in only 2 hours, instead of 20+ hours required by the shallow water well drilling rigs (Category A).

FIGS. 5A to 5D illustrate a drill bit 502 for generating geothermal boreholes according to some embodiments.

Figure 5A:
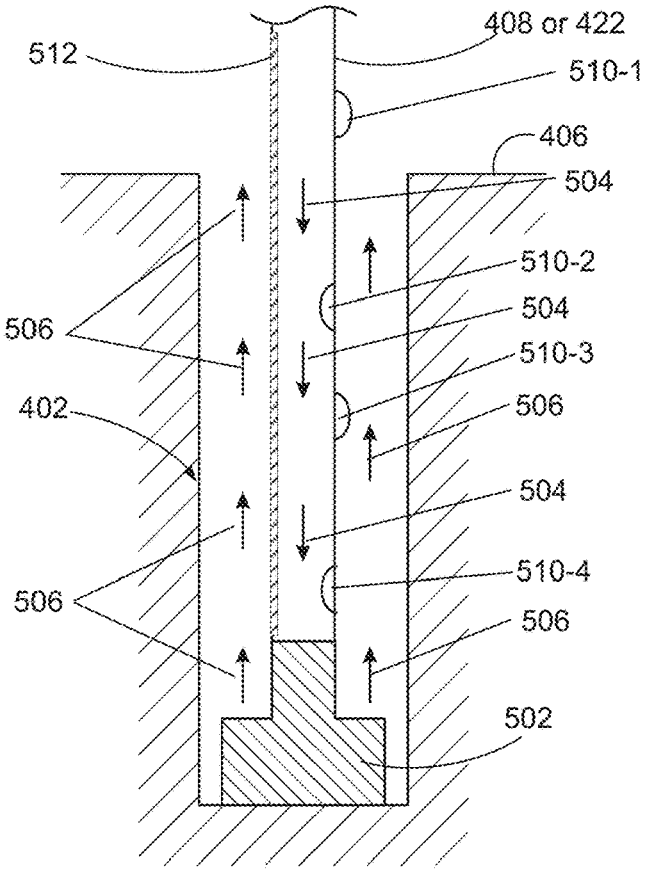
FIGS. 5A to 5D illustrate a drill bit for generating geothermal boreholes in accordance with some embodiments.
Figure 5B:
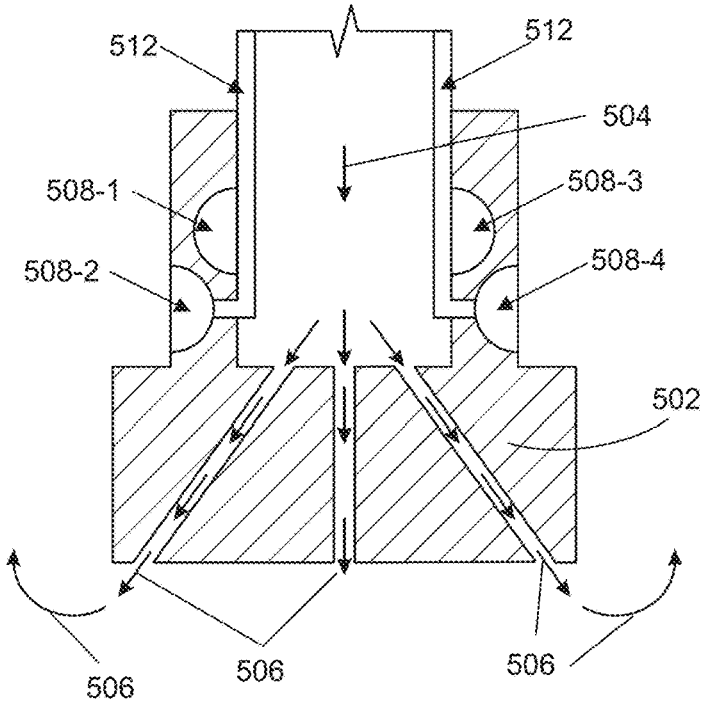

FIG. 5A illustrates a cross-sectional view that shows a drill bit 502 mounted on one end of a CT 408 and/or a joint pipe 422, to facilitate drilling of the geothermal boreholes. FIG. 5B illustrates a cross-sectional view of the drill bit 502 according to some embodiments. The drill bit 502 is rotated by a motor (not shown) that is hydraulically activated by pumping drilling fluid (e.g., water and/or bentonite) through the CT 408 or the joint pipes 422. The arrows 504 in FIGS. 5A and 5B indicate the direction of the drilling fluid as it is pumped through the CT 408 and/or a joint pipe 422. The arrows 506 in FIGS. 5A and 5B indicate the flow direction of drilling mud (e.g., water and/or bentonite and debris) as it exits the drill bit 502 and motor.

In some embodiments, the drill bit 502 includes sensors 508 (e.g., underground or downhole sensors) that are designed to measure underground parameters in-situ, as (e.g., during, while) the geothermal boreholes are being drilled/constructed. The underground parameters include temperature, pressure, humidity, lithology, azimuth, stresses, and/or depth correlation. In some embodiments, the sensors 508 collect downhole data having data types that are illustrated in FIG. 5E.

In some embodiments, the sensors 508 are positioned on both the interior surface and the exterior surface of the drill bit 502. For example, FIG. 5B illustrates four downhole sensors 508-1 to 508-4. The sensors 508-1 and 508-3 are positioned on the interior surface of the drill bit 502. The sensors 508-2 and 508-4 are positioned on the exterior surface of the drill bit 502.

In some embodiments, at least two of the sensors 508 have the same sensor type. As an example, the sensor 508-1 and the sensor 508-2 can both be temperature sensors. As another example, the sensor 508-1 and the sensor 508-3 can both be pressure sensors.

In some embodiments, the sensors 508 include two sensors having the same sensor type. One of the two sensors is positioned on the interior surface and the other of the two sensors is positioned on the exterior surface. For example, in FIG. 5B, both the sensor 508-1 and the sensor 508-2 can be temperature sensors. The positioning of temperature sensors on both the interior and exterior surface of the drill bit 502 enables one to determine the temperature of the drilling fluid (e.g., drilling mud) before it enters the drill bit 502 after it exits the drill bit 502. By knowing these temperature values, one can calculate (e.g., determine) parameters such as frictional forces and heat generated by the frictional forces (e.g., by applying relations such as mass-momentum conservation energy in pipes).

In some embodiments, the CT 408 and/or joint pipes 422 also include one or more sensors 510 (e.g., surface sensors) that can be positioned along (e.g., between) the surface 406 and a depth of the geothermal borehole 402. In some embodiments, the surface sensors 510 can be positioned on the surface 406, on the CT injector 410, on the reel 412, and/or anywhere on the truck 414. The surface sensors 510, such as the sensors 510-1 to 510-4 as shown in FIG. 5A, measure surface data in-situ, as the geothermal boreholes are being drilled/constructed. In some embodiments, the sensors 510 measure (e.g., collect) data such as fluid rate, pressure, temperature, and/or a length of the CT or joint pipe running into the borehole. In some embodiments, the sensors 510 collect surface data having data types that are illustrated in FIG. 5E.

In some embodiments, the sensors 510 are positioned on both the interior surface and the exterior surface along the CT 402/joint pipes 422.

In some embodiments, at least two of the sensors 510 have the same sensor type.

In some embodiments, the sensors 510 include two sensors having the same sensor type. One of the two sensors is positioned on the interior surface along the CT 402/joint pipes 422, and the other of the two sensors is positioned on the exterior surface along the CT 402/joint pipes 422.

FIG. 5E illustrates exemplary types of surface data and downhole data that are collected by the sensors 508 and the sensors 510 in accordance with some embodiments.

With continued reference to FIG. 5, in some embodiments, the underground data collected by the sensors 508 and/or the sensors 510 can be transferred to the surface (e.g., to the geothermal planning and optimization system 200) automatically and in real-time using telemetry wires 512. The telemetry wires 512 also transfer power from the surface to the sensors 508 and/or the sensors 510. In some embodiments, the telemetry wires 512 are associated with telemetry technologies such as electrical conduits or mud pulse telemetry, both of which are used for oil and gas CT operations. The electrical conduits (e.g., wires) have the dual advantage of being capable of much higher data transmission rates and being capable to also power to the underground sensors 508 (and to the surface sensors 510) from the surface. In the case of mud pulse telemetry, the underground sensors 508 would need to be powered by batteries, making the drill bits much bigger.

Figure 5C:
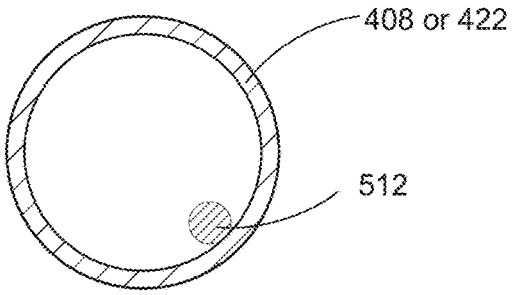

FIG. 5C is a cross-sectional view of a CT 408/joint pipe 422. In this example, the telemetry wire 512 is located on an internal wall (e.g., interior surface) of the CT 408/joint pipe 422.

Figure 5D:
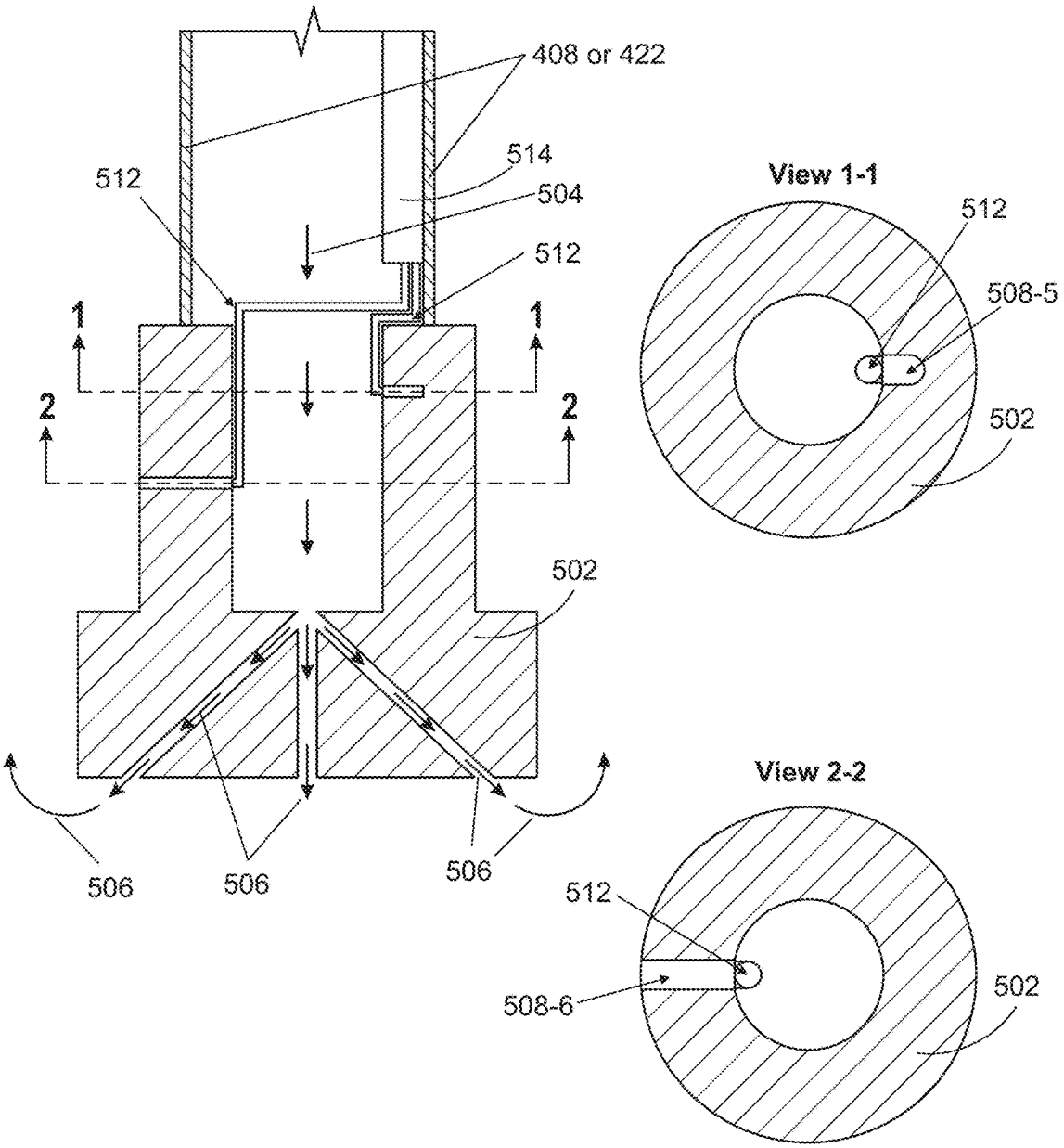

FIG. 5D is a cross-sectional view of the CT 408/joint pipe 422 and the drill bit 502, showing positions of the telemetry wire 512, a telemetry tube 514, and the flow directions the drilling fluid/drilling mud are represented by arrows 504 and arrows 506. The view in direction 1-1 shows the telemetry wire 512 positioned on the interior surface of the drill bit 502. The view in direction 1-1 also illustrates coupling (e.g., an electrical coupling, a communicative coupling) between the telemetry wire 512 and a sensor 508-5. In this example, the sensor 508-1 is an internal sensor (e.g., it is positioned on an interior surface of the drill bit 502). The view in direction 2-2 illustrates coupling (e.g., an electrical coupling, a communicative coupling) between the telemetry wire 512 and a sensor 508-6-5. In this example, the sensor 508-6 is an external sensor (e.g., it is positioned on an exterior surface of the drill bit 502).

Figure 6A:
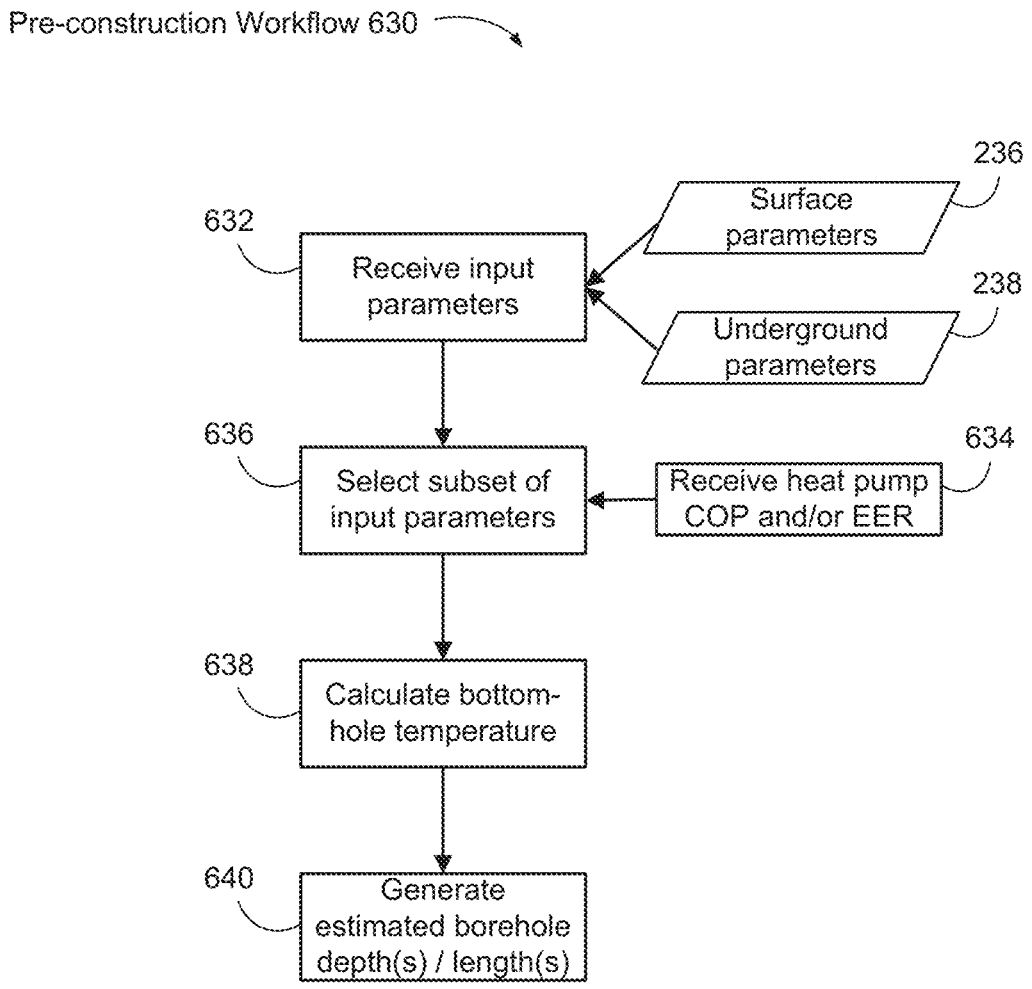
FIGS. 6A to 6C illustrate an integrated workflow for planning, constructing, and/or optimizing a GHCS operation, in accordance with some embodiments.
Figure 6B:
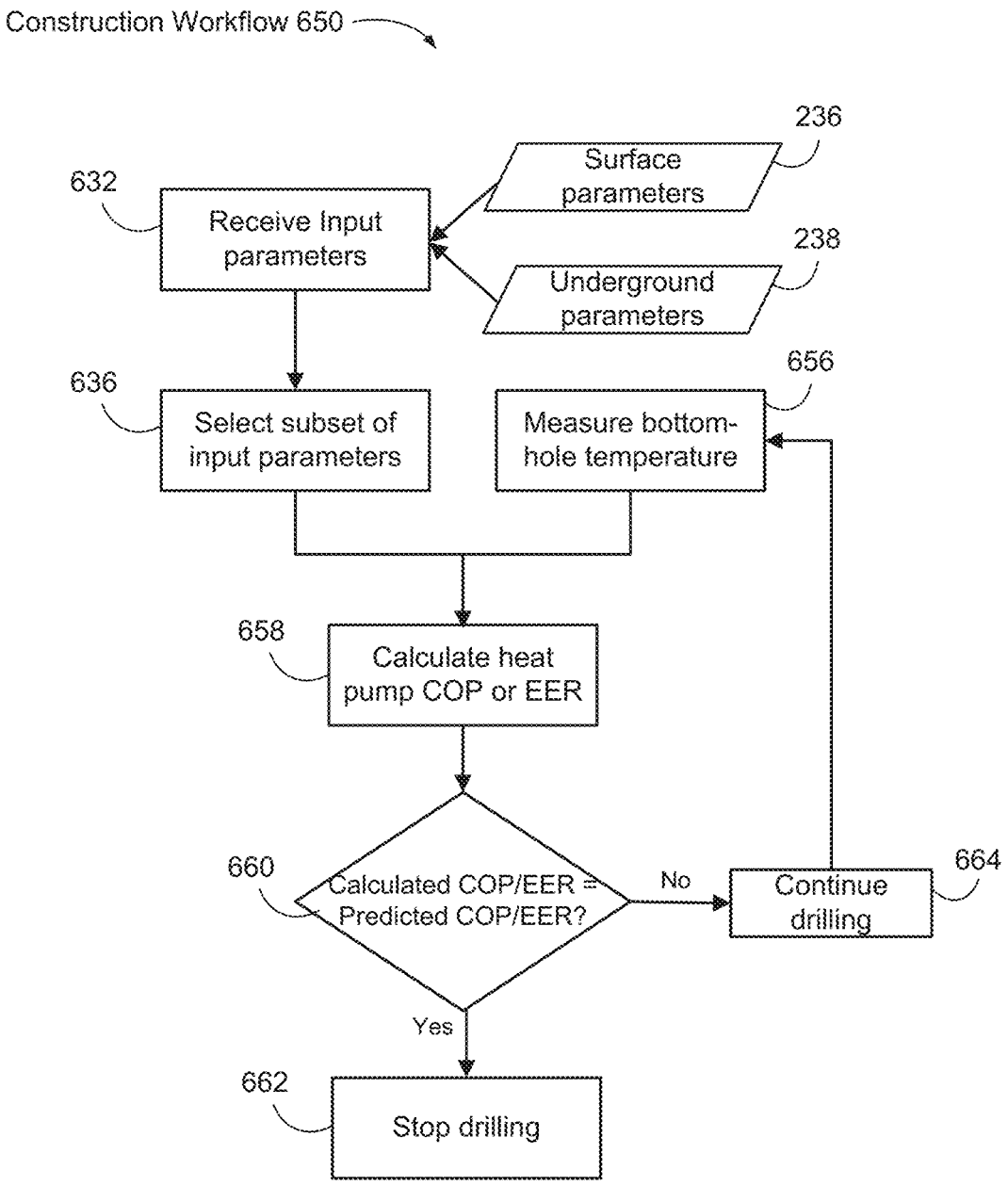
Figure 6C:
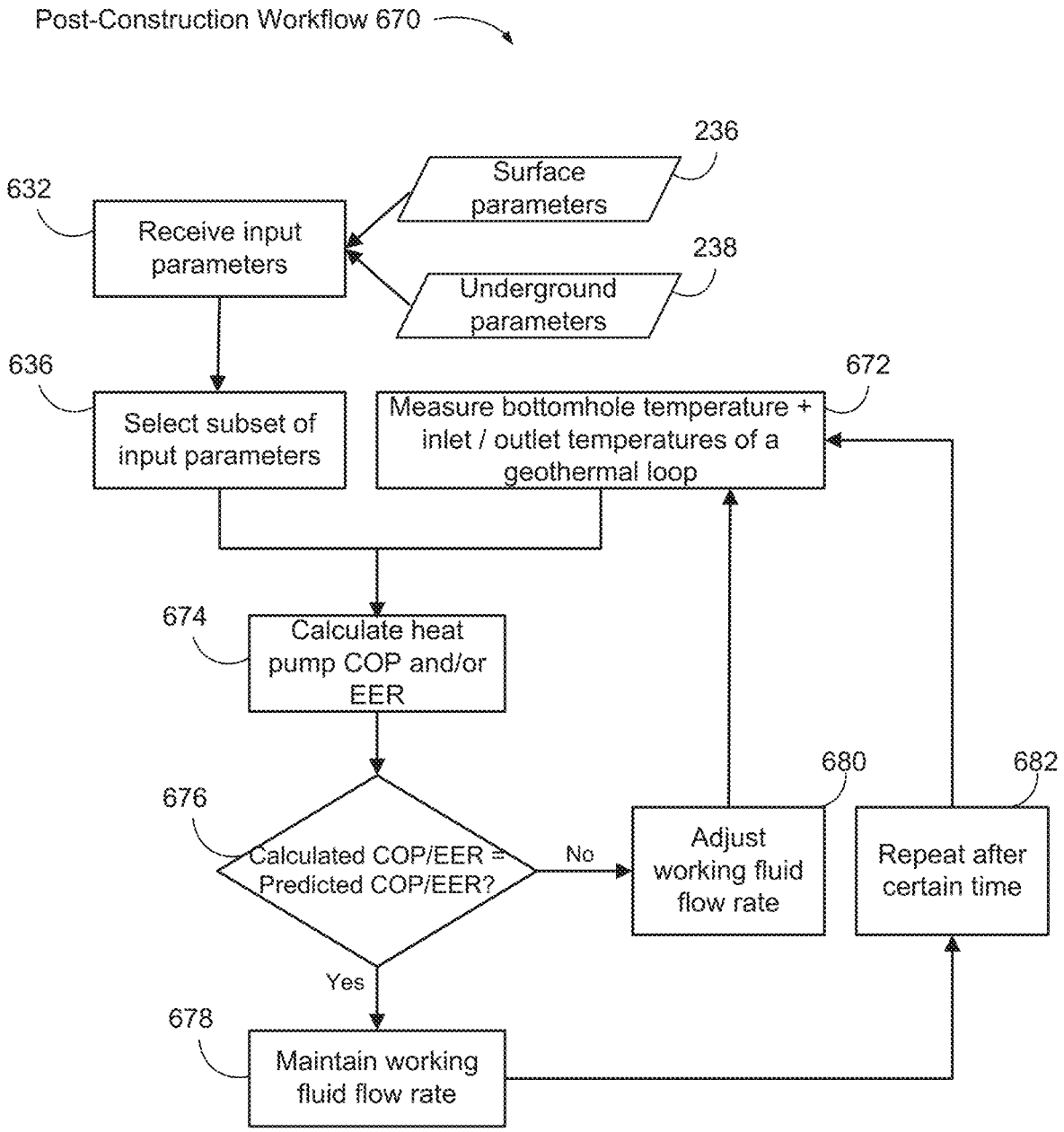

FIGS. 6A to 6C illustrate an integrated workflow (e.g., integrated workflow 628) for planning, constructing, and/or optimizing a GHCS operation, in accordance with some embodiments. In some embodiments, the workflow 628 includes a combination of one or more of: pre-construction workflow 630, a construction workflow 650, and a post-construction workflow 670. The workflows 630, 650, and 670 are executed by a processor (e.g., processor 202 or processor 302), in accordance with some embodiments. In some embodiments, each of the workflows 630, 650, and 670 can be executed as a standalone workflow.

FIG. 6A illustrates a pre-construction workflow 630 that is executed by a processor (e.g., processor 202 or processor 302) during a pre-construction phase of a GHCS operation, according to some embodiments.

The workflow 630 includes receiving (632) input parameters (e.g., specified by a user, the system 200, or the server 120). The input parameters can include surface parameters 236 and/or underground parameters 238. In some embodiments, the input parameters include default (e.g., pre-defined) values that can be modified and/or overridden by a user.

The workflow 630 includes receiving (634) (e.g., from a user) a heat pump COP for heating and/or EER for cooling. In some embodiments, the heat pump COP/EER comprises a manufacturing COP/EER of the heat pump as specified by the pump manufacturer. In some embodiments (e.g., for large buildings), two or more heat pumps that work in tandem or independently may be used. The workflow 630 includes receiving respective heat pump COPs/EERs corresponding to each of the two or more heat pumps. In some embodiments, in addition to (or instead of) receiving the heat pump COP/EER, the workflow can measure heat transfer (e.g., directly, by measuring a temperature difference in an object) or indirectly, by calculation) and use the measured heat transfer as a proxy for determining the COP/EER. For example, in some embodiments, the workflow 630 includes measuring (or receiving) one or more temperatures of a geothermal fluid, such as an inlet and/or an outlet temperature. In some embodiments, the workflow 630 includes measuring (or receiving) a heat transfer coefficient of the heat between a subsurface and a geothermal borehole.

The workflow 630 includes selecting (636) (e.g., by the processor), or receiving user selection of, a subset of input parameters. The workflow 630 includes calculating (638) a bottom-hole temperature of a geothermal borehole to be constructed, based on the selected subset of input parameters. The workflow 630 includes generating (640) (e.g., by the processor, by applying the model 126) estimated borehole parameters, such as the borehole depth, length, and/or diameter.

In some embodiments, in accordance with receiving the heat pump COP and/or EER in step 634, the processor generates a range of COP and/or EER values (e.g., by applying the model 126), to obtain a range of borehole parameters, which in turn facilitates a builder to properly design and plan the drilling job, obtain the right drilling permits, and/or for plan the geothermal loops for an optimal long-term underground heat transfer process.

In some embodiments, execution of the workflow 630 provides (e.g., generates) operational parameters of one geothermal borehole. In a construction that involves multiple boreholes, the workflow 630 is executed repeatedly, each of the iterations generating a set of borehole parameters for a respective borehole.

FIG. 6B illustrates a construction workflow 650 that is executed by a processor (e.g., processor 202 or processor 302) during the construction phase of a GHCS operation, according to some embodiments. In some embodiments, the workflow 650 includes the step 632 and the step 636 as described previously with respect to FIG. 6A.

In some embodiments, the workflow 650 includes, in step 656, measuring (e.g., by one or more sensors) the bottom-hole temperature of a geothermal borehole during the construction of the borehole. For example, as illustrated in FIGS. 5B and 5D, sensors 508 can be mounted on a drill bit 502 that is used for drilling a geothermal borehole. In some embodiments, the sensors 508 include temperature sensors for measuring (e.g., automatically and in real time) a bottom-hole temperature as the geothermal borehole is being drilled. In some embodiments, the workflow 650 includes measuring surface and downhole conditions (e.g., pressure, temperature, and/or flow rate) during the construction of the borehole, from surface sensors (e.g., sensors 510) and underground sensors (e.g., sensors 508).

In some embodiments, the workflow 650 includes, in step 658, calculating (e.g., by the processor) the heat pump COP/EER based on the selected subset of input parameters and the measured bottom-hole temperature. For example, the processor updates the model 126 based on the measured bottom-hole temperature, and applies the updated model to determine a calculated (e.g., actual, modified) heat pump COP/EER.

In some embodiments, the workflow 650 includes comparing (660) the calculated COP/EER with a predicted COP/EER (e.g., predicted by the model 126 or a machine learning database 130). The workflow 650 includes, in step 662, terminating the drilling process when the calculated COP/EER matches the predicted COP. The workflow 650 includes, in step 644, continuing the drilling of the geothermal borehole (e.g., drilling deeper, varying a drilling angle and/or a borehole diameter) when the calculated COP/EER does not match the predicted COP/EER.

Stated another way, the downhole sensors (e.g., sensors 508) encased in the drill bit 502 allow re-calibration of the model 126 in real time. That is, actual temperature data is acquired in real time during drilling, which changes the output of initial design model dynamically. This empowers the field personnel to optimize the operational parameters on-the-fly, e.g., drilling shorter, longer, or wider wells to ensure the optimal performance of each GHCS installation.

FIG. 6C illustrates a post-construction workflow 670 that is executed by a processor (e.g., processor 202 or processor 302) during the post-construction phase of a GHCS operation, according to some embodiments. In some embodiments, the workflow 670 includes the step 632 and the step 636 as described previously with respect to FIG. 6A.

In some embodiments, the workflow 670 includes, in step 672, measuring the bottom-hole temperature (e.g., of a borehole or a geothermal loop) and an inlet/outlet temperature of a geothermal loop (e.g., geothermal loop 604). In some embodiments, after the geothermal borehole 402 has been constructed, an optical fiber is placed inside the constructed borehole, for collecting the temperature along a geothermal loop constructed based on the borehole. In some embodiments, the bottom-hole temperature is determined indirectly via calculations (e.g., solving a loop-pipe flow thermodynamic equation, or determining a temperature profile along the geothermal loop loop).

In some embodiments, the workflow 670 includes, in step 674, calculating a heat pump COP for heating and/or a heat pump EER for cooling. The workflow 670 includes. in step 676, comparing the calculated COP with a predicted COP/EER (e.g., predicted by the model 126). The workflow 670 includes, in step 678, maintaining a current flow rate of a working fluid in the geothermal loop when the calculated COP/EER matches the predicted COP/EER. The workflow 670 includes, in step 680, adjusting the flow rate of the working fluid in the geothermal loop when the calculated COP/EER does not match the predicted COP/EER.

In some embodiments, the workflow 670 includes, in step 682, repeating the measuring and calculating (e.g., steps 672, 674, and 676) after a certain time (e.g., every month, every three months, every year, or every change of season), and maintaining or adjusting the flow rate of the working fluid accordingly.

In a geothermal system, heat exchange occurs (1) between the geothermal loop and the building and (2) between the geothermal loop and the near constant-temperature thermal reservoir from the underground rocks. The underground heat transfer process between the working fluid 606 and the underground rocks (e.g., the underground region surrounding the geothermal loop) can be calculated by solving a radial (i.e., one-dimensional) diffusion equation in the near-borehole region (e.g., 10 to 30 feet radially from the borehole). The initial temperature of the near-borehole region is different from the long-term pseudo-steady-state temperature of the same region. The temperature of the near-borehole region changes over time due to several reasons. First, for heating, the working fluid picks up heat from the underground rocks and brings it to the surface, so the inlet temperature of the geothermal loop (see, e.g., FIG. 7) is lower than the outlet temperature of the geothermal loop. If the fluid is continuously circulated, heat is produced from the underground, so the temperature in the near-borehole region decreases over time until it reaches a pseudo-steady-state temperature, which is lower than the initial underground temperature. On the other hand, for cooling, the working fluid loses heat to the underground rocks, so the inlet temperature of the geothermal loop is higher than the outlet temperature of the geothermal loop. If the fluid is continuously circulated, heat is lost to the underground, so the temperature in the near-borehole region increases over time until it reaches a pseudo-steady-state temperature, which is higher than the initial underground temperature. Stated another way, because the pseudo-steady-state temperature of the near-borehole region is expected to vary from the initial temperature when the geothermal loop is first installed, the working fluid flow rate may need to be adjusted over time to ensure optimal long-term performance of the GHCS.

Figure 7:
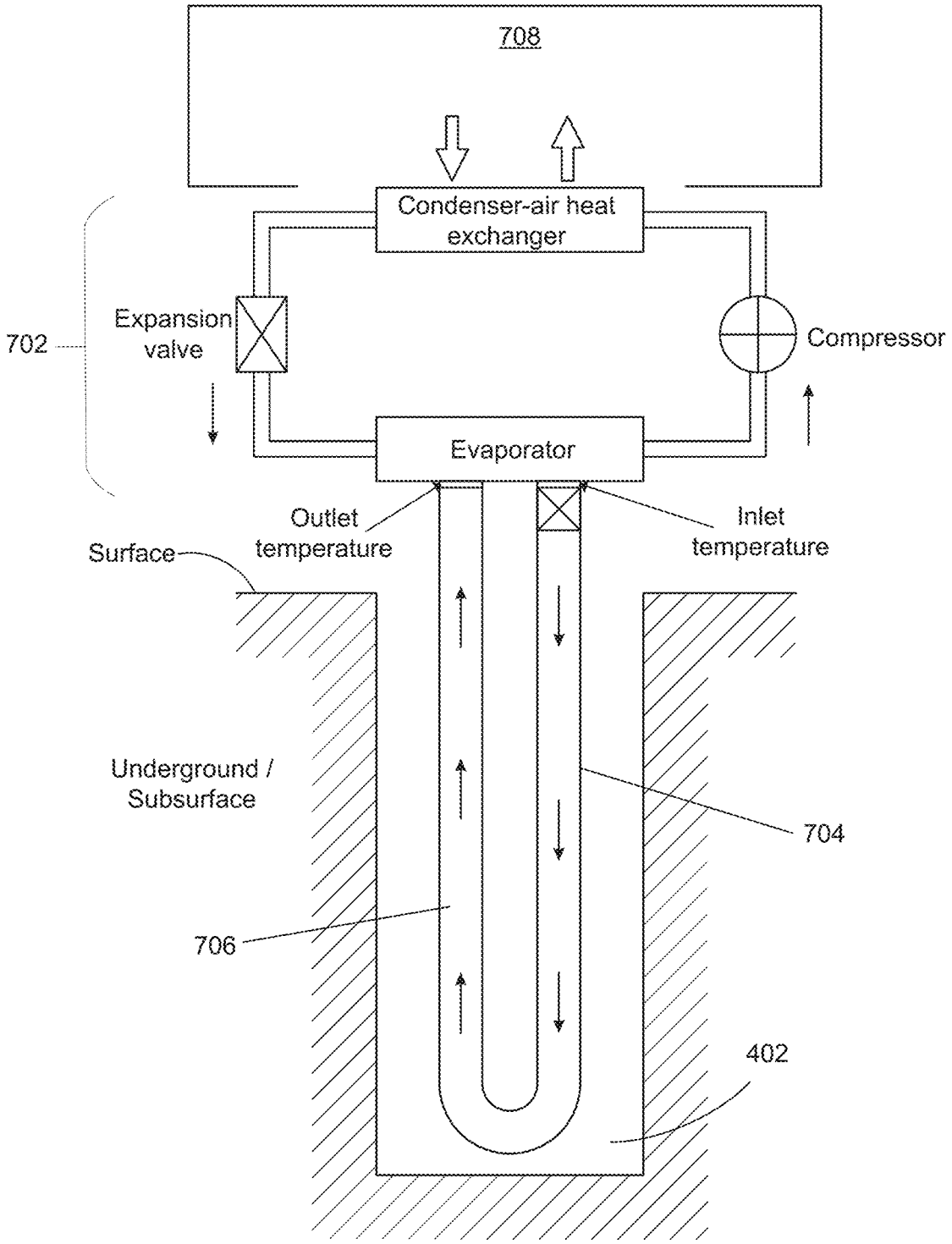
FIG. 7 illustrates a heat pump and a geothermal loop in accordance with some embodiments.

FIG. 7 illustrates a heat pump 702 and a geothermal loop 704 in accordance with some embodiments. In some embodiments, the geothermal loop 704 is constructed from a geothermal borehole 402. The geothermal loop 704 comprises a pipe that is made of a material such as high-density polyethylene (HDPE), fiberglass or carbon steel. The geothermal loop 704 can be installed as a U-loop into a borehole 402 and connected to a heat pump 702 of a building 708. The heat pump 702 uses the nearly constant temperature underground to heat or cool the interior of a building 708. The geothermal loop 704 is filled with a fluid 706 (e.g., a working fluid, such as a refrigerant) that circulates inside the geothermal loop 704. In summer, the surface air has a higher temperature compared to the underground temperature. The fluid 706 absorbs heat from the surface and releases it underground. In winter, the surface air has a lower temperature compared to the underground temperature. The fluid 706 absorbs heat from the underground and releases it to the surface. In some embodiments, the heat pump 702 includes a reversing valve, which lets the heat pump 702 switch directions to either heat or cool the building.

Figure 8A:
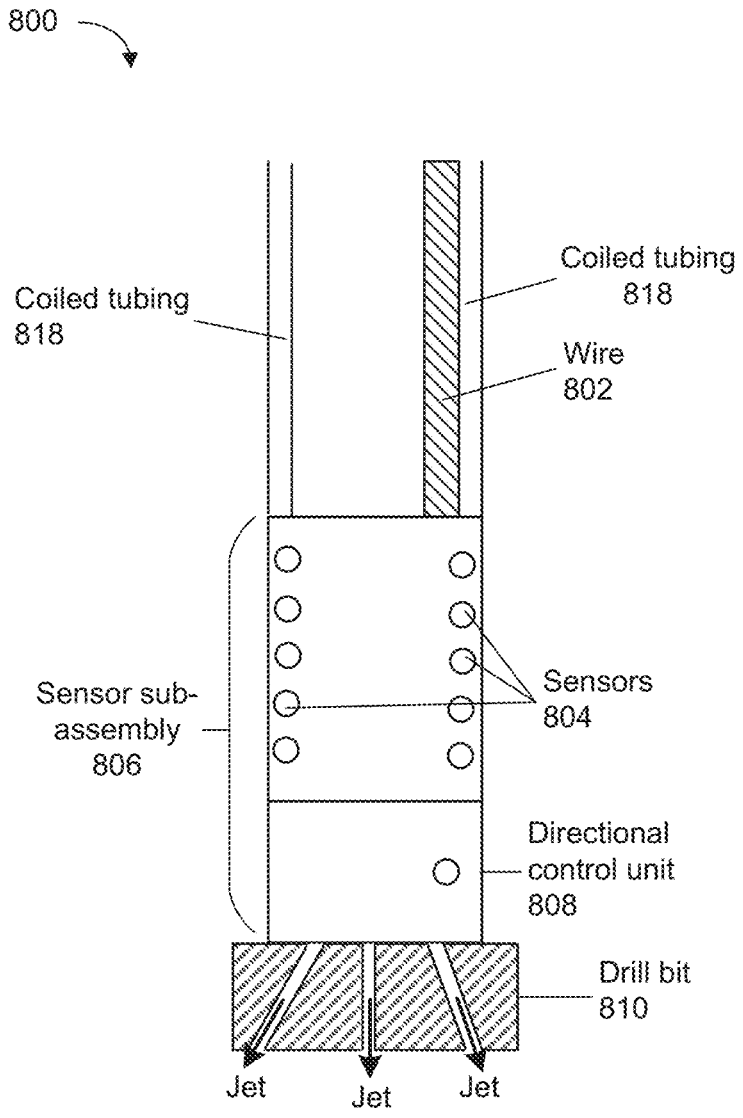
FIGS. 8A to 8D illustrate a downhole telemetry system, in accordance with some embodiments.

FIG. 8A illustrates a downhole telemetry system (e.g., downhole telemetry assembly) 800, in accordance with some embodiments. In some embodiments, the telemetry system 800 is part of a bottom hole assembly (BHA) (e.g., the lowest part of the drill string that is driven into the subsurface during borehole construction).

The telemetry system 800 includes a wire 802 (e.g., telemetry wire). In some embodiments, the wire 802 is used for transferring power from the surface to the sensors 804 (e.g., sensors 508). In some embodiments, underground data (e.g., downhole telemetry data) collected by the sensors 804 (e.g., or sensor sub-assembly 806) can be transferred to the surface automatically in real-time using the wire 802.

In some embodiments, the telemetry system 800 includes a sensor sub-assembly 806. In some embodiments, the sensor sub-assembly 806 includes a directional control unit 808 for controlling a drilling direction using data measured from an array of sensors 804. In some embodiments, the directional control unit 808 is hydraulically activated. In some embodiments, the directional control unit 808 is electrically activated.

The sensor sub-assembly 806 includes sensors 804. The sensors 804 can include one or more pressure sensors, one or more temperature sensors, one or more gamma ray sensors, one or more inclination (e.g., azimuth) sensors, one or more vibration sensors, one or more acceleration sensors, one or more force sensors, one or more torque sensors, one or more pH sensors, one or more salinity sensors, and/or one or more thermal conductivity sensors.

In some embodiments, the sensors 804 are downhole sensors that measure subsurface data. The sensors 804 are positioned on both an interior surface and the exterior surface of the sensor sub-assembly 806.

In some embodiments, the system 200 includes surface sensors that are located on above the ground, for collecting surface data.

In some embodiments, the sensors 804 include a first downhole temperature sensor that is positioned internal to the sensor sub-assembly 806 and a second downhole temperature sensor that is positioned external to (e.g., facing the subsurface) the sensor sub-assembly 806. The combination of the first and second downhole temperature sensors are used to determine a geothermal gradient while drilling.

In some embodiments, the sensors 804 include inclination and/or azimuth sensor(s) for determining whether lateral drift (e.g., a distance between an actual borehole distance and a planned trajectory) while drilling. The lateral drift can be a displacement in a horizontal plane, in any direction, assuming that the borehole is vertical. In some embodiments, the lateral drift is a distance between an actual borehole distance and a planned trajectory, measured with respect to a plane perpendicular to the borehole axis.

In some embodiments, data collected from the downhole sensors 804 is used for determining whether a geothermal loop is installed at target depth and/or grout is filling the borehole entirely.

In some embodiments, the sensors 804 are arranged in an array. For example, in some embodiments, the sensors are arranged with a geometric pattern so as to be able to measure geological data (e.g., rock data) in three dimensions (e.g., directionally radial data).

In some embodiments, the sensors 804 are positioned on the exterior surface of the drill bit or in/on the telemetry sub-assembly located between the drill bit 810 and a CT connector. For example, the sensors that are positioned on the exterior surface of the drill bit can include: a force sensor, a torque sensor, a pressure sensor, a temperature sensor, a vibration sensor, a pH, a gamma ray sensor, and/or an azimuth/orientation sensor.

In some embodiments, the sensor sub-assembly (e.g., the telemetry system) uses force and/or vibration data obtained (e.g., measured) by the force and/or vibration sensors, to calibrate the data measured by the other sensors (e.g., pressure data, temperature data, etc.) based on the measured vibrations. Without this calibration, the data can be noisy.

Figure 8B:
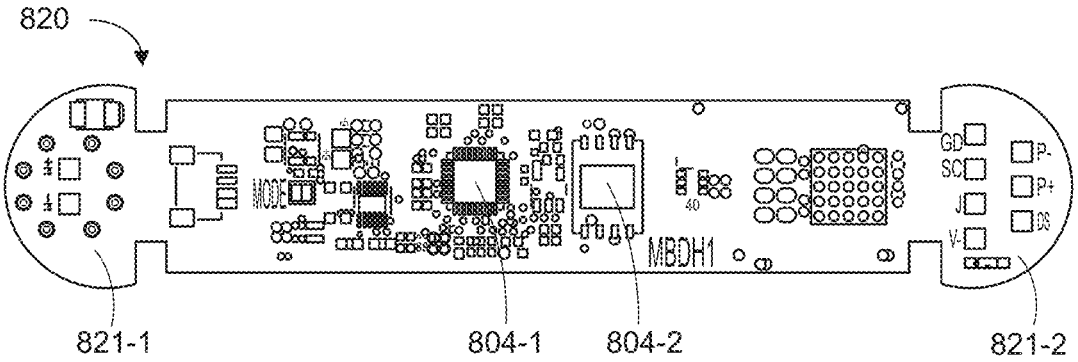
Figure 8C:
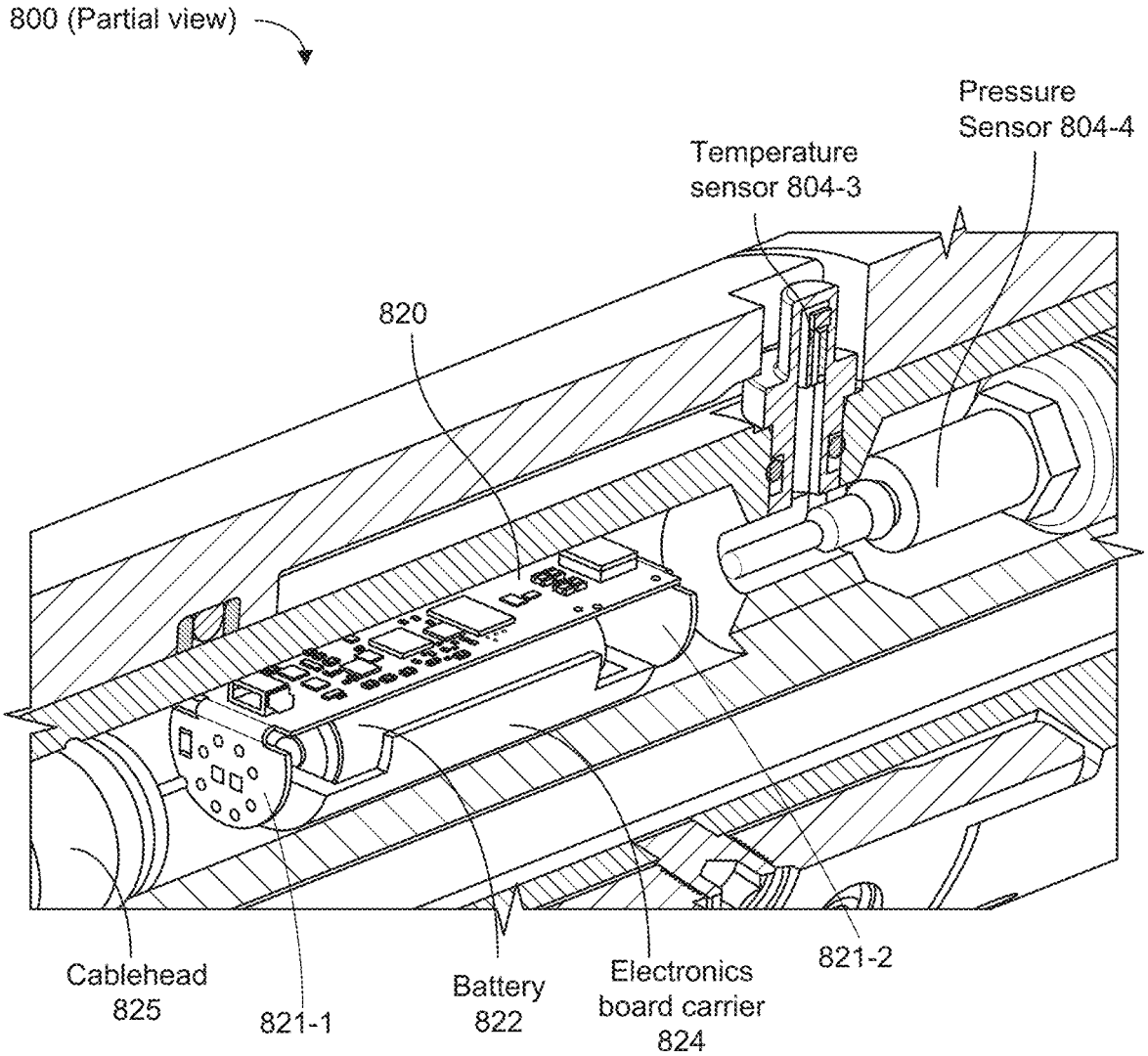
Figure 8D:
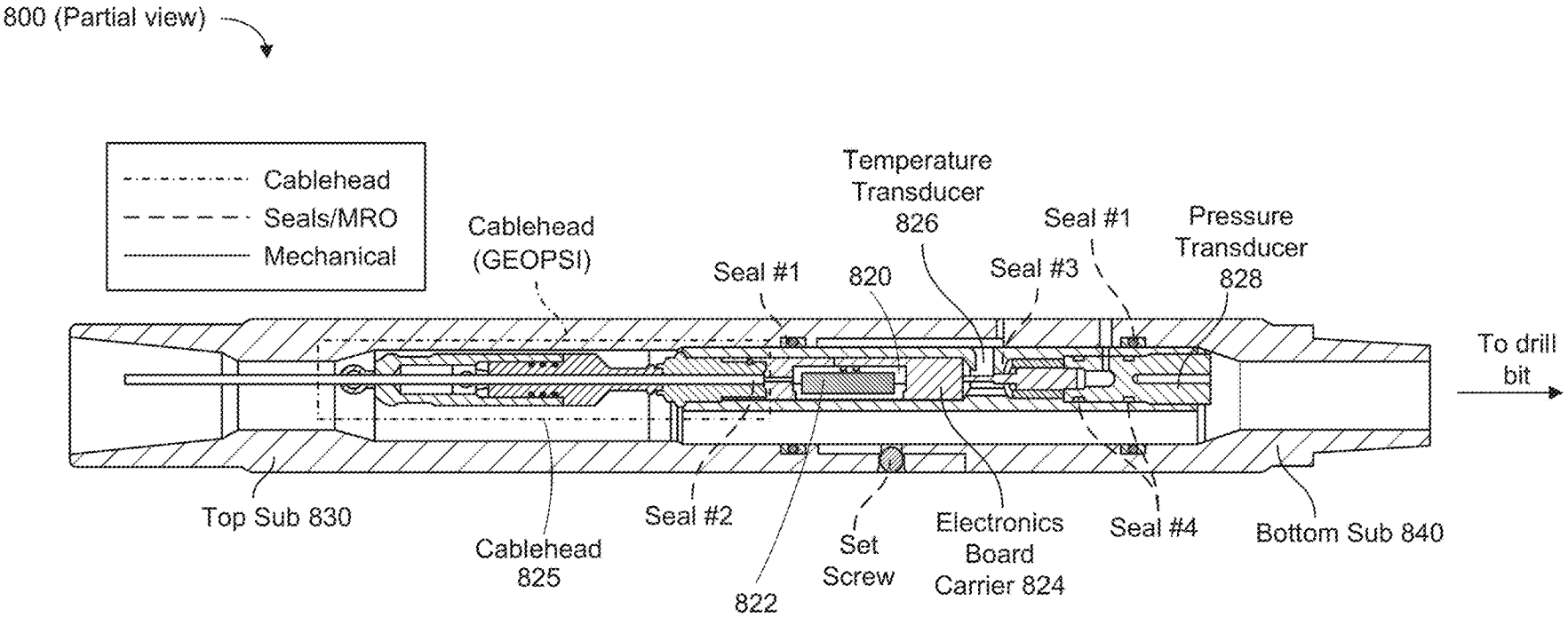

FIGS. 8B, 8C, and 8D illustrate that, in some embodiments, the telemetry system 800 can include a flexible electronics board 820 (e.g., downhole telemetry board). In some embodiments, at least a subset (e.g., one or more) of the downhole sensors 804 (e.g., sensor 802-1 or sensor 802-2) are mounted on the electronics board 820, whereas the remaining downhole sensors (e.g., temperature sensor 804-3 and pressure sensor 804-4) are located at other parts of the telemetry system 800. In some embodiments, sensors that located on the flexible electronics board 820 can include acceleration sensor(s), azimuth sensor(s), or vibration sensor(s). Sensors that are located at other parts of the telemetry system 800 (i.e., not mounted on the electronics board) can include a temperature sensor 804-3 and a pressure sensor 804-4. The temperature sensor 804-3 can be part of a temperature transducer 826. The pressure sensor 804-4 can be part of a pressure transducer 828.

FIG. 8C illustrates a partial perspective view of the telemetry system 800, in accordance with some embodiments. As illustrated in this view, the electronics board 820 can be bent (e.g., folded at sides 821-1 and 821-2) and partially wrapped around a battery 822. This configuration not only saves space, but also improves the signal-to-noise ratio of the signals collected by sensors (e.g., sensor 804-1 and/or 804-2) that are mounted on the electronics board 820. Suppose that sensor 804-1 is a vibration (or acceleration) sensor. Because the flexible electronics board 820 with the sensors is relatively light (e.g., a few grams), the signals collected by the vibration sensor will be noisy. The additional weight provided by the battery 822 can improve the measurements acquired by the vibration or acceleration sensor, which can in turn be processed (e.g., filtered) with greater accuracy.

In some embodiments, the battery 822 is the primary source of power for the electronics board 820. In some embodiments, the battery 822 is a backup source for powering the electronics board 820 when the wiring in the CT fails. In some embodiments, the battery 822 is a rechargeable battery.

FIG. 8D illustrates a partial cross-sectional view of the telemetry system 800, showing the top portion (top sub 830) and the bottom portion (bottom sub 840) of the telemetry system 800, in accordance with some embodiments.

In accordance with some embodiments, the telemetry system 800 disclosed herein advantageously improves geothermal field construction. For example, a requirement for current drillers (e.g., in a city) is that they have to map/verify that the constructed boreholes are vertical. Because current geothermal borehole construction technologies do not incorporate built-in sensors, the industry practice is to drill about 100 feet every time, insert a wireline (e.g., a wire with sensors) to measure and confirm that the geothermal borehole is (e.g., still) in the direction the drillers believe the borehole should be, drill another approximately 100 feet, and repeat the measurement process. In contrast to the existing systems, the telemetry system 800 includes sensors positioned on (and/or within) the drill bit, thereby enabling the system to continuously monitor the drilling and intervene if needed.

Systems and Methods for Electrical Resistivity Tomography (ERT) Measurements During Geothermal Field Construction Some embodiments of the present disclosure are directed to applying Electrical Resistivity Tomography (ERT) to detect the presence of objects ahead of a drill bit bit during drilling and avoid potential hazards.

ERT is a geophysical technique for measuring the spatial distribution and contrast of electrical resistivity in the subsurface. The theory and modes of operation of ERT, as well as its typical uses, are described in The Contaminated Site Clean-Up Information (CLU-IN) website at clu-in.org/characterization/technologies/default2.focus/sec/Geophysical_Methods/cat/Electrical_Resistivity_Tomography/, the contents of which are incorporated by reference herein in its entirety.

While the use of ERT has been demonstrated in applications such as soil mapping and subsurface characterization, obtaining real time ERT measurements data during drilling remains a challenge due to the dynamics of the drilling process and variations in subsurface structures encountered during drilling. This can, in turn, influence the quality or signal-to-noise ratio (SNR) of the acquired data. In some instances, the ERT measurement parameters need to be constantly tuned during drilling to adapt to the changing properties of the subsurface structures. Such capabilities do not exist in current ERT systems.

Some embodiments of the present disclosure are directed to a novel downhole ERT device or system (e.g., system 900) that acquires ERT data of subsurface structures (e.g., rocks) during (e.g., while, in real time) drilling. In some embodiments, the disclosed downhole ERT system adaptively tunes the impedances between the electrodes and the under-test material by controlling an electrolytic conductivity of the drilling fluid to achieve optimal contrast (e.g., signal-to-noise ratio).

In the oil and gas industry, ERT can be performed during drilling, but no electrode can be placed in the drilling bottomhole assembly (BHA). This means that the ERT data is collected using electrodes that are all positioned at the surface during drilling, or with a downhole array of electrodes as a logging tool after drilling. By contrast, in the present disclosure, the ERT device is introduced subsurface, during the drilling, and the quality (e.g., a signal-to-noise ratio or a contrast level) of the ERT data collected is adjusted by adjusting a conductivity of the drilling fluid.

Figure 9:
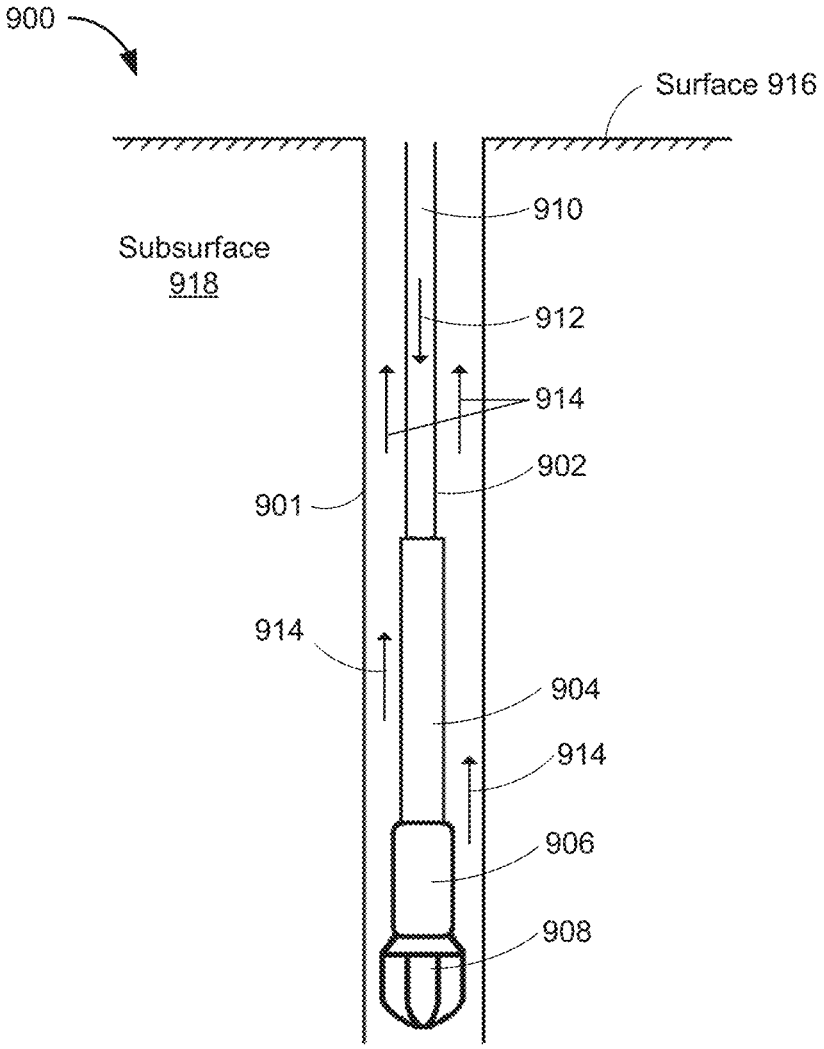
FIG. 9 illustrates a system for constructing geothermal boreholes, in accordance with some embodiments.

FIG. 9 illustrates a partial view of a system 900 for constructing geothermal boreholes, such as geothermal borehole 901, in accordance with some embodiments. The system 900 includes a coiled tubing (CT) string 902 (see, e.g., CT 408 in FIGS. 4A and 5A or CT 818 in FIG. 8A). The system 900 includes a drill bit 908 is coupled to one end of the CT string 902. A motor 906 is coupled to the drill bit 908 and provides power to the drill bit 908 while drilling. In some embodiments, the motor 906 is a motor that is hydraulically activated by pumping drilling fluid 910 (e.g., drilling mud, water and/or bentonite) through the CT string 902. The arrow 912 indicates the flow direction of the drilling fluid 910 as it is pumped through the CT string 902, and the arrows 914 indicate the flow direction of drilling fluid 910 as it exits the motor 906 and the drill bit 908.

In some embodiments, the system 900 includes an ERT device 904 for measuring electrical resistivity in the subsurface. The ERT device 904 is positioned above the motor 906. In some embodiments, the return fluid (i.e., drilling fluid 910 whose flow direction is indicated by arrows 914) makes an electrical connection between electrodes 1002 located on an outer wall of the ERT device 904 and an inner wall of the drilled borehole 901.

In some embodiments of the present disclosure, the ERT device 904 acquires ERT data (e.g., in real time) while a geothermal borehole is being drilled by the system 900. Depending on the quality (e.g., contrast or SNR) of the ERT data that is obtained, the system 900 can dynamically adjust (e.g., in real time, on-the-fly) an electrolytic conductivity of the drilling fluid 910 mud to achieve ERT data (e.g., images) with optimum contrast or SNRs.

In some embodiments, the electrolytic conductivity of the drilling fluid 910 can be dynamically adjusted by adding impurities to the drilling fluid 910. Using water as the the drilling fluid 910 as an example, adding NaCl or KCl to water increases its conductivity because the ions dissolve and can carry an electric current. On the other hand, bentonite that has been activated with nitric, phosphoric, or sulfuric acid can significantly reduce the electrical conductivity of water by 31-39%.

In some embodiments, the electrolytic conductivity of the drilling fluid 910 can be dynamically adjusted by reducing the amount and/or concentration of impurities that are present in the drilling fluid 910. For example, salts such as NaCl or KCl, or bentonite that is already present in the drilling fluid 910 can be removed by filtration or reduced in concentration by adding fresh water.

In some embodiments, the electrolytic conductivity of the drilling fluid 910 can be dynamically adjusted by changing a temperature of the drilling fluid 910. For example, an increase in temperature may cause an increase in the number of ions (e.g., Na+ or K+ ions) in the solution due to dissociation of molecules. As the conductivity of a solution is dependent on these ions, an increase in the drilling fluid's temperature can lead to an increase in its conductivity. On the other hand, a decrease in temperature can decrease the conductivity of the drilling fluid 910.

In some embodiments, prior to deployment of the system 900 on site, the electrolytic conductivity data of the drilling fluid can be collected in the lab by varying the impurities concentration and/or downhole temperature range. The data can be input into a processor of the system (e.g., CPU(s) 202), or into model 126, for use in the field during the ERT measurements.

Figure 10:
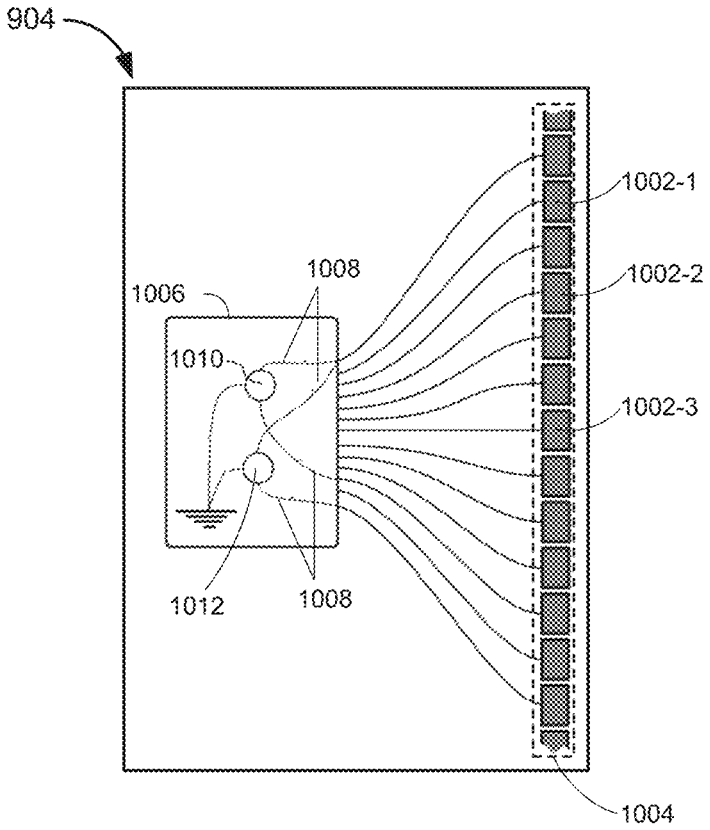
FIG. 10 illustrates an electrical resistivity tomography (ERT) measurement device, in accordance with some embodiments.

FIG. 10 illustrates the ERT device 904, in accordance with some embodiments. The ERT device 904 includes electrodes 1002 (e.g., electrode 1002-1 to electrode 1002-3) that are connected to a measurement device 1006, and for acquiring electrical resistivity data from the subsurface. The numbers of electrodes 1002 can range anywhere from 2 electrodes to 128 electrodes. In some embodiments, the electrodes 1002 are arranged in one or more arrays. The electrodes 1002 can be arranged in a line, an arc, or on a curve or multiple lines with an elbow with any angle.

In some embodiments, the electrodes 1002 (e.g., the one or more arrays 1004) can be positioned on an outer surface of the ERT device 904. During the construction of the borehole, the electrodes 1002 come into direct contact with the drilling fluid 910.

In some embodiments, a surface area of the electrodes 1002 can be treated to increase their surface area. The surface treatment can be performed via a variety of ways, including sand blasting, chemical treatment, sputtering, or electroplating. An increased surface area of the electrodes 1002 can lead to a corresponding increase in a contact area between the electrodes 1002 and the drilling fluid 910, and a corresponding increase in a contact area between the electrodes 1002 and the subsurface structures.

Surface treatment of the electrodes can increase the double layer capacitance at the electrode-fluid interface. Double-layer capacitance is the physical principle that occurs at the interface between a surface and a fluid, where two layers of electric charge with opposing polarities form. In this example, one of the layers is at the surface of the electrode and the other layer is in the electrolyte. The two layers are typically separated by a single layer of solvent molecules that act like a dielectric in a conventional capacitor. The characteristics of this electrode-fluid interface are important for recording high quality ERT data with reduced noise.

With continued reference to FIG. 10, in some embodiments, the measurement device 1006 includes digital or analog switches 1008 that electrically connect each electrode 1002 or a group of electrodes into a voltage/current signal generator 1010. The connection between the electrodes and the signal generator 1010 can be single-ended with a common ground or it might be differential. Single-ended signals tend to require a relatively high voltage to ensure adequate SNR. Common single-ended interface voltages are 3.3 V and 5 V. Because of their improved resistance to noise, differential signals can use lower voltages and still maintain adequate SNR. The signal generator 1010 is capable of generating any DC or AC voltage or current signal, or a combination of DC and AC signals with any waveform and frequency, to enable power to be transferred efficiently to the ERT device 904 downhole. Exemplary waveforms can include a square wave, a sinusoidal wave, a rectangle wave, or any arbitrary waveform with any DC biasing. In some instances, the ERT device 904 uses DC voltage and current to measure the resistivity of the rocks (e.g., subsurface structure. In some embodiments, the system 900 is capable of transferring AC power downhole and then convert it to DC.

In some embodiments, the measurement device 1006 includes digital or analog switches 1008 to electrically connect each electrode 1002 or a group of electrodes into a voltage/current measurement unit 1012. The connection between the electrodes 1002 and the measurement device 1006 can be single-ended with a common ground or it might be differential. The measurement unit 1012 is capable of measuring the phase and/or amplitude of a current or a voltage signal. The measurements can be performed using analog circuits such as a peak detector circuit, a phase detector circuit, an analog RMS detector, an analog lock-in amplifier, or an analog IQ demodulator, or through digital sampling and signal processing to calculate a phase or amplitude of the signal using variety of digital algorithms such as Fourier transfer, digital IQ demodulator, cross correlation, or zero crossing. In some embodiments, the measurement device 1006 includes an internal pre-amplifier to amplify the input signals.

Figure 11C:
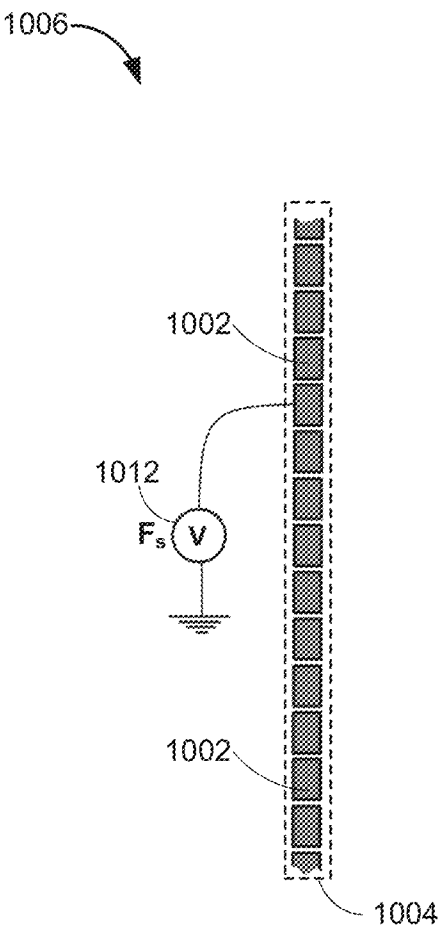
FIGS. 11A to 11C illustrate various scan plans that can be executed by an ERT measurement device, in accordance with some embodiments.
Figure 11B:
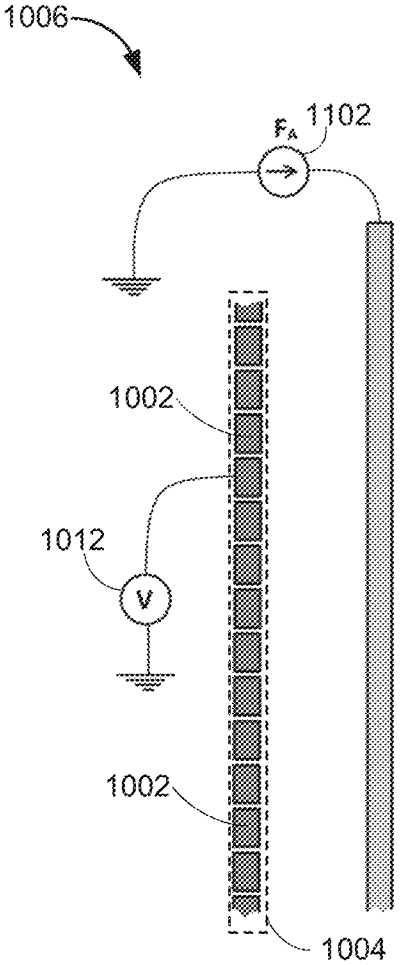
Figure 11A:
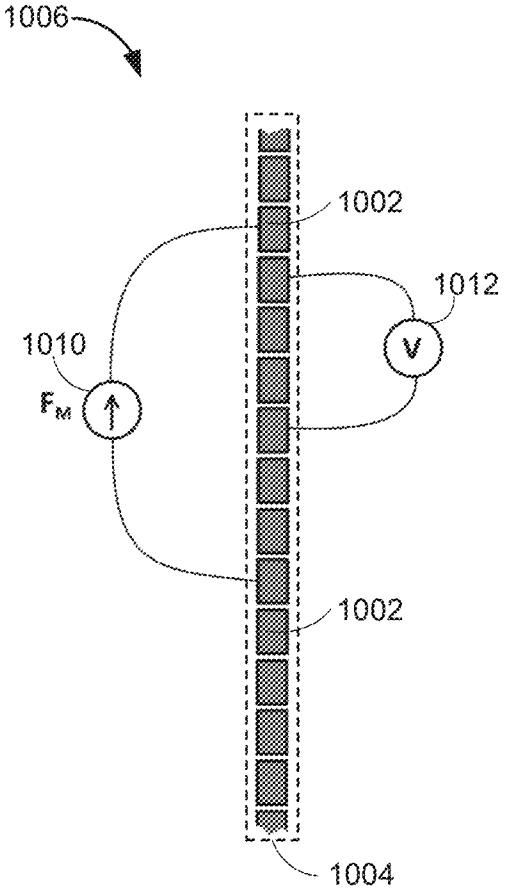

FIGS. 11A to 11C illustrate various scan plans that can be executed by measurement device 1006 to acquire ERT data, in accordance with some embodiments.

In some embodiments, as illustrated in FIG. 11A, the measurement device 1006 follows a scan plan for the main frequency (FM) differential measurement. In each step of this scan plan, the signal generator 1010 applies a sine-wave current signal with the main frequency (FM) on two electrodes 1002, and the measurement unit 1012 measures the voltage the electrodes 1002. Analog switches 1008 will then switch to other electrodes in the next step to scan the entire electrode arrays. The excitation current signal is applied at the main frequency (FM), where FM is precisely selected away from stray electrical line noise (e.g., 50 Hz and 60 Hz noises) and their harmonics (e.g., multiples of 50 Hz and 60 Hz). The vibration of the drill bit is continuously measured using a vibration sensor and the FM frequency is adjusted away from the vibration frequencies of the drill bit. The measurements can also be performed by applying a voltage signal into two electrodes and measuring the current signal at other two electrodes. The measurement device 1006 includes a microcontroller to perform the scan plan and controls the switches 1008, signal generator 1010, and measurement unit 1012.

In some embodiments, the measurement device 1006 can follow an active Frequency (FA) measurement scan plan. This is illustrated in FIG. 11B. In the active frequency scan plan, a signal generator 1102 applies a sine-wave current or voltage signal with the active frequency (FA) into one or multiple conductors accessible from the surface. FA can be applied to detect objects such as pipelines and non-energized cables. Different frequencies can correlate to different obstacles; these obstacles can be detected as they are different than the surrounding rocks. Depending on their shape/trajectory and other potential information such as utilities map, the detected objects can be identified (e.g., pipelines, gas lines, underground powerlines).

The measurement unit 1012 measures the voltage or current signals of one electrode at each step of the active scan plan. The FA is precisely selected away from stray electrical line noise (e.g., 50 Hz and 60 Hz noises) and their harmonics. The vibration of the drill bit is continuously measured using a vibration sensor and the FA frequency is adjusted away from the vibration frequencies.

In some embodiments, the measurement device 1006 can follow a sniffing test scan plan. This is illustrated in FIG. 11C. The sniffing test scan plan can be performed on all electrodes while no main signal or active signal is applied. In each step of this scan plan, the microcontroller connects one electrode or a group of electrodes into the measurement unit 1012 to measure the voltage or current at Sniffing Frequency (FS). FS is set at an electrical line noise frequency (e.g., 60 Hz or 50 Hz), or one of the harmonics of the electrical line noise frequency. In some embodiments, FS can also be set at the known frequencies other than the frequency of the electrical line noise or their harmonics.

In some embodiments, depending on the available current/system (e.g., DC or AC, amplitude, or frequency), one of FA, FM, or FS can be used to map underground obstacles and rock layers. in some embodiments, the system 900 can perform one or a combination of the scan plans for the Main frequency, Active Frequency or Sniffing Frequency. In some embodiments, the FA, FM, and FS scan plans can be executed sequentially, if the current frequency can be varied.

As disclosed, the term "signal measurement" includes amplitude measurements, phase measurements, and/or both amplitude and phase measurements.

Electrical Drilling Systems and Methods for Geothermal Field Construction

Some embodiments of the present disclosure are directed to electrical drilling systems and methods for geothermal field construction.

Current drilling technologies for deep oil and gas are mostly hydraulics based. A rotary drilling bottom hole assembly (BHA) is operated by pumping drilling mud (e.g., using a hydraulic pump) through coiled tubing or drilling pipes and includes a rotating drill bit, a motor with a stator and rotor (for coiled tubing), and a directional tool to steer the drill bit. For joint pipes, the entire system of pipes and drill bit are rotating, while the drilling mud (drilling fluid) is used to cool down the drill bit and carry the drilling cuttings to surface. For coiled tubing, the drilling mud is pumped through the drilling motor, which transforms the axial fluid flow into rotation and rotates the drill bit. The science and engineering of the drilling mud can be complex. Not only that, drilling requires the use of large volumes of drilling fluids and are prone to lost returns, especially if the hole is drilled through natural factures or thief zones. The lost fluid is an additional expense and complicates the operational logistics due to the large volumes of fluids. It can also be cumbersome to store and/or dispose drilling mud in urban and commercial settings.

The problems associated with hydraulics based drilling technology can be overcome using electrical based drilling technology. However, electrical drilling technologies are presently not employed in the oil and gas industry because huge power losses can be incurred when transmitting electricity across cables that are over 10,000 feet long. It is also not practical to have electrical cables of these lengths to transmit power to the drill bit.

These challenges associated with electrical drilling technologies in deep oil and gas can be overcome in the case of drilling mid-range-length wells that are between 500 and 3,000 feet deep, where power losses are not as high. Advantageously, electrical BHAs emit less greenhouse gases, especially if the electricity is produced from renewable energy. Electrical BHAs are also more environmentally friendly compared to gas- and diesel-powered BHAs.

Figure 12:
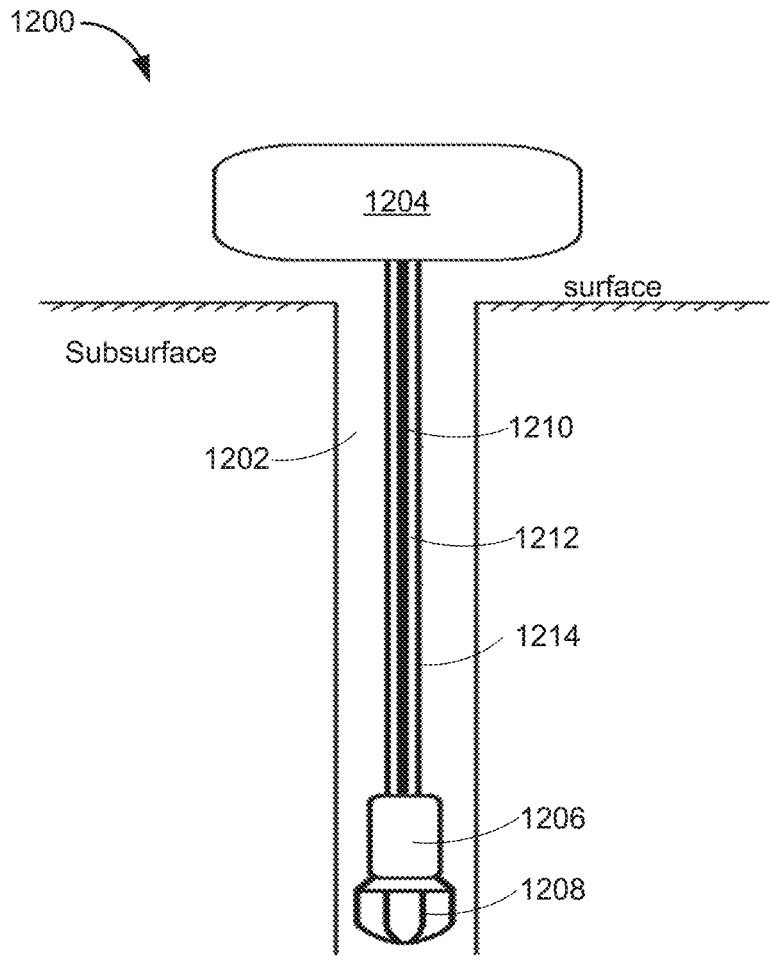
FIG. 12 illustrates a system for constructing geothermal fields, in accordance with some embodiments.

FIG. 12 illustrates a system 1200 for constructing geothermal fields, in accordance with some embodiments. A geothermal field can include one or more boreholes such as geothermal borehole 1201. The system 1200 includes an electrical power source 1204 and an electric motor 1206 that is coupled to a drill bit 1208 (e.g., electrical drill bit). The system 1200 includes a first electrical conductor 1210 (represented by the inner black line), a second electrical conductor 1214 (represented by the outer black lines), and an electrical insulator 1212 separating the first electrical conductor and the second electrical conductor. During use of the system 1200, at least a portion of the length of the first electrical conductor 1210 transfers power from the electrical power source 1204 to the electric motor 1206 (or vice versa), and at least a portion of the length of the second electrical conductor 1214 transfers electrical current from electric motor 1206 to the electrical power source 1204 (e.g., to form a closed loop electric circuit).

In some embodiments, at least a subset of the electrical power source 1204, electric motor 1206, drill bit 1208, first electrical conductor 1210, electrical insulator 1212, and second electrical conductor 1214 are part of an electrical bottomhole assembly (BHA). For example, in some embodiments, the electrical BHA can include any combination of: an electrical drill bit, an electrical drilling motor, an electrical directional tool, and/or any other electrical-based tools such as hammers, tractors, and sensory sub-assemblies.

In some embodiments, the electrical power source 1204 is located at the surface during drilling. In some embodiments, the electrical power source 1204 is located at the subsurface during drilling. In some embodiments, the electrical power source 1204 is a battery. In some embodiments, the electrical power source 1204 is a battery that is located inside the first electrical conductor 1210 or the second electrical conductor.

In some embodiments, the electrical power source 1204 comprises a rectified DC power from an ac power line on the surface.

In some embodiments, the electric motor 1206 comprises a brushless motor with an electric motor driver circuit installed in the electrical BHA.

In some embodiments, the first electrical conductor 1210 is coiled tubing (e.g., CT or CT string, such as CT 408, CT 818, or CT 902), whereas the second electrical conductor 1214 is an electrically conductive cable that is different from the CT.

In some embodiments, the second electrical conductor 1214 is coiled tubing (e.g., CT or CT string, such as CT 408, CT 818, or CT 902), whereas the first electrical conductor 1210 is an electrically conductive cable that is different from the CT.

Figure 13A:
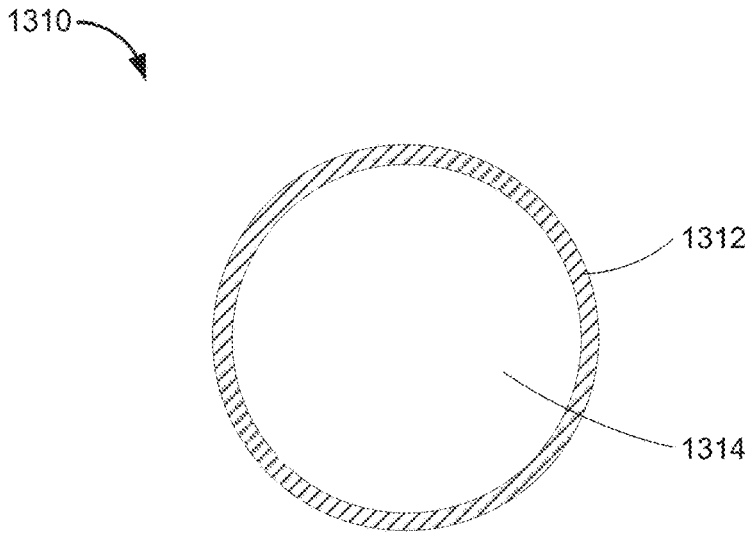
FIGS. 13A and 13B illustrate cross-sectional views of coiled tubing, in accordance with some embodiments.
Figure 13B:
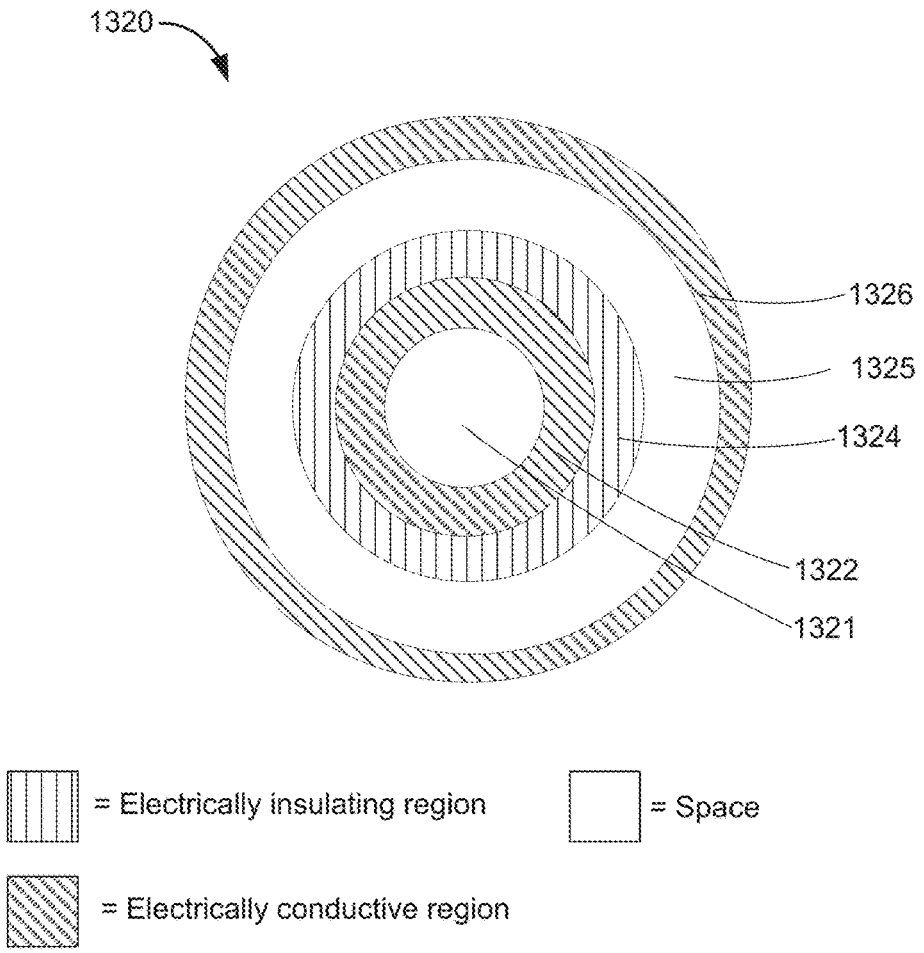

FIGS. 13A and 13B illustrate cross-sectional views of CT 1310 and CT 1320 respectively, in accordance with some embodiments.

In FIG. 13A, the CT 1310 is a tube (e.g., a cylindrical body) that includes a wall 1312 with a space 1314 inside the wall. During borehole construction, drilling fluid is pumped through the space 1314 to the drill bit. In some embodiments, the first electrical conductor 1210 is the CT 1310. Drilling fluid can be injected from the surface to the subsurface through the CT 1310 can return to the surface through the space between the first electrical conductor 1210 and the wall of the geothermal borehole 1202.

In FIG. 13B, the CT 1320 is a concentric CT string that includes an inner tube defined by space 1321 and an electrically conductive region 1322; an electrically insulating region 1324 that surrounds the inner tube; and an outer tube that surrounds both the inner tube and the electrically insulating region. The outer tube includes space 1325 and an electrically conductive region 1326.

In some embodiments, the concentric CT string forms a closed loop electrical circuit whereby current is transferred from the power source to the electrical motor along the center of the concentric CT string (e.g., along a length of the electrically conductive region 1322) and returns along the outer shell of the concentric CT string (e.g., along a length of the electrically conductive region 1326).

In some embodiments, the concentric CT string forms a closed loop electrical circuit whereby current is transferred from the power source to the electrical motor along the outer shell of the concentric CT string (e.g., along a length of the electrically conductive region 1326) and returns along the center shell of the concentric CT string (e.g., along a length of the electrically conductive region 1322).

The electrically insulating region 1324 prevents shorting between the electrically conductive region 1322 and the electrically conductive region 1326.

In some embodiments, during drilling of the borehole, drilling fluid flows from the surface to the subsurface through the space 1325 between the electrically conductive region 1326 and the electrically conductive region 1322, and flows from the subsurface to the surface through the space 1321.

In some embodiments, during drilling of the borehole, drilling fluid flows from the surface to the subsurface through the space 1321, and flows from the subsurface to the surface through the space 1325.

In some embodiments, the first electrical conductor 1210 is the inner region (i.e., electrically conductive region 1322) of the CT 1320 and the second electrical conductor 1214 is the outer region (i.e., electrically conductive region 1326) of the CT 1320.

In some embodiments, the first electrical conductor 1210 is the outer region 1326 of the CT 1320 and the second electrical conductor 1214 is the inner region 1322 of the CT 1320.

In some embodiments, while the CT is spooled from the reel during drilling, one end of the CT (i.e., the end that is on the surface) remains fixed (i.e., does not move) and connected to a computing device (e.g., geothermal planning and optimization system 200). For example, a slip connector can be used to connect the surface end of the CT to the computing device. In some embodiments, the surface end of the CT can be communicatively connected to the computing device via a wireless connection.

In some embodiments, the system 1200 requires a high-power slip ring mechanism to continuously connect the electric power source 1204 to the electric motor 1206 while the spool of the coil is rotating.

Figure 14:
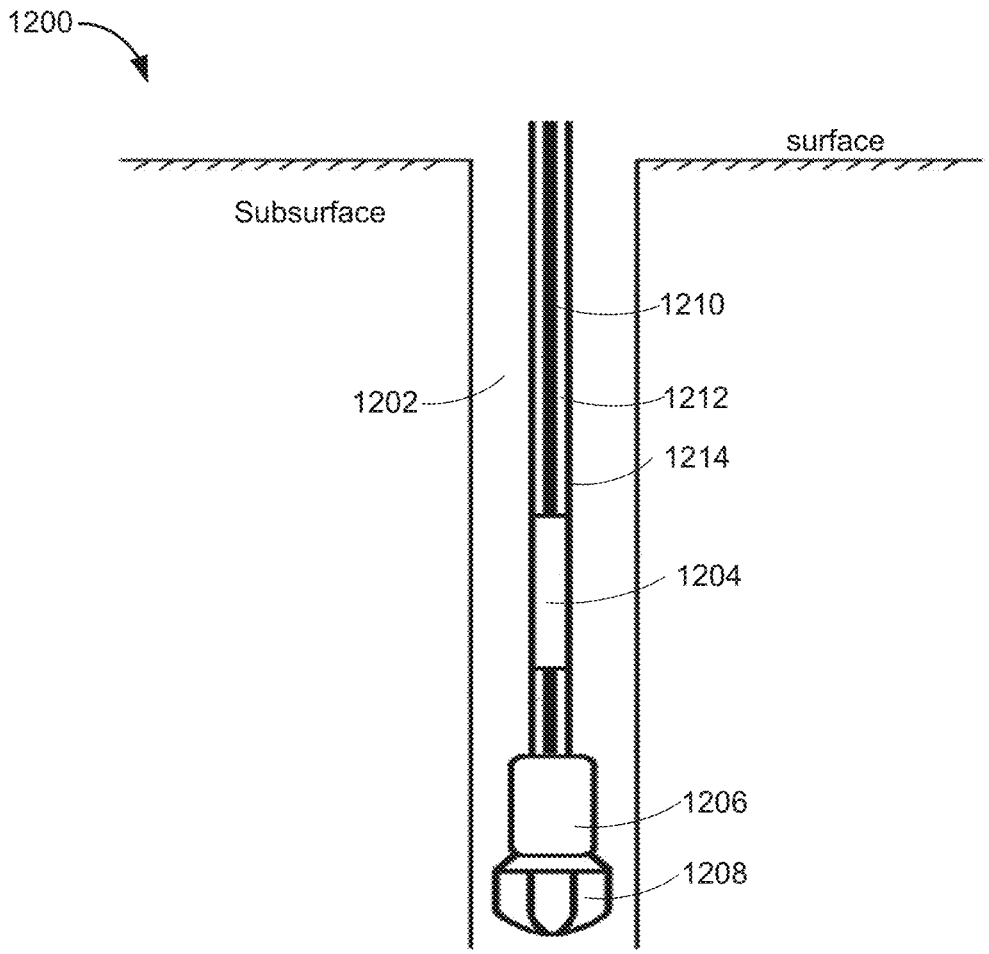
FIG. 14 illustrates a system for constructing geothermal fields, in accordance with some embodiments.

FIG. 14 illustrates another embodiment of the system 1200, in accordance with some embodiments. In this example, the electrical power source 1204 comprises a battery pack that is placed inside the first electric conductor 1210. Using this configuration, the drilling fluid can be used for cooling down (e.g., removing the heat generated by) the battery pack, the electric motor 1206, and the drill bit 1208. The battery pack can be encapsulated with an electrical insulator (e.g., plastic or teflon) to minimize the risk of electrical shorting.

In some embodiments, the battery pack has a voltage with a lower limit of 10V, 25V, 50V, 100V, 150V, 200V, 250V, 300V, 400V, or 500V. In some embodiments, the battery pack has a voltage with an upper limit of 100V, 150V, 200V, 250V, 300V, 400V, 500V, 600V, 700V, 800V, 900V, 1 kV, 5 kV, 10 kV, 50 kV, or 100 kV. In some embodiments, the battery pack has a power with a lower limit of 25 kW, 50 kW, 100 KW, 200 kW, 300 KW, 400 kW, or 500 kW. In some embodiments, the battery pack has a power with an upper limit of 100 KW, 200 kW, 300 kW, 400 kW, 500 kW 600 kW, 700 kW, 800, 900 KW, 1 MW, 5 MW, 10 MW, 50 MW, or 100 MW.

In some embodiments, the electrical BHA can be powered up from the surface via an electrical connector.

In some embodiments, the connection between two adjacent components of the electrical BHA (e.g., drill bit and motor, motor and directional tool) comprises an electrically actuated connection similar to a human elbow, to facilitate bending of the electrical BHA during drilling (e.g., different components of the electrical BHA are not aligned with respect to one another). The electrically actuated connections (e.g., joints) can be between two adjacent components, or within one component. Because the entire electrical BHA can be quite long (e.g., 20 feet or longer), drilling in an inclined or horizontal direction will require a large radius of curvature (e.g., 50 feet or more) between a section of the electrical BHA that is vertically oriented and another section of the electrical BHA that is horizontally oriented, which is impractical in dense urban environments where space is typically limited. A bendable electrical BHA significantly reduces the radius of curvature and makes it compact and portable to operate in urban and suburban areas.

In some embodiments, the electrical BHA can latch a casing and pull the casing subsurface during drilling, to maintain the borehole stability. In some embodiments, the electrical BHA includes an electrical mechanism to unlatch the casing and leave it in the borehole. The casing can be made of steel, plastic, or carbon fiber.

In some embodiments, with directional control for fully steerable drilling, and/or a hammer or tractor for increasing the weight on the drill bit, the first electrical conductor 1210 and/or the second electrical conductor 1214 would be similar to a wireline system (i.e., not coiled tubing). Drilling fluid can be pumped down through the casing pulled by the electrical BHA, and the return drilling fluid can flow to the surface via an annular space between the casing and borehole walls. After unlatching the casing in the borehole, the drill bit can be retrieved back to the surface through the casing.

In some embodiments, the electrical BHA comprises a drill bit with a segment that expands (e.g., in diameter) when the drill bit is rotated, and contracts (e.g., in diameter) when the drill bit is not rotated and/or rotated in the opposite direction. The enlarged diameter that is created allows the casing to be pulled into the hole more easily. The reduced diameter facilitates removal of the drill bit from the casing when the drilling is completed.

In some embodiments, the system 1200 includes an electrically controlled CT injector (e.g., an electrically actuated injector instead of a hydraulically controlled CT injector) for driving the CT string from the surface into the subsurface.

In some embodiments, the hydraulic mechanism of pumping water through coiled tubing to rotate the rotor of a drilling motor, which in turn rotates the drill bit, is replaced with an electrical motor that rotates the drill bit.

In some embodiments, the hydraulic control and hydraulic brakes of the coiled tubing reel are replaced with electric control and brakes.

In some embodiments, a hydraulic pump (usually triplex) is replaced with an electric pump.

In some embodiments, the geo-loop reel control and brakes (currently manually operated) are replaced with electric control and breaks.

In some embodiments, the system 1200 uses sensors that measure voltage, resistance, and/or impedance values for all electric components (e.g., drill bit, injector, coiled tubing reel, pumps, cuttings separation (i.e., solids control) system, geo-loop reel, grout mixing equipment), to measure the health of the entire system and control its functionality.

Thermal Conductivity Measurements for Optimizing Geothermal Field Construction

Some embodiments of the present disclosure are directed to determining surface and subsurface thermal conductivity properties of geological structures for optimizing geothermal field construction.

As discussed with reference to FIGS. 1 and 2, some embodiments of the present disclosure provide a model 126 (also referred to as a geothermal model) that generates operational parameters 242 constructing a geothermal borehole based on input parameters 234 such as thermal conductivity properties of surface and subsurface structures (e.g., rocks). Having a rich and comprehensive dataset of the subsurface characteristics that influence a geo-field's thermal performance can lead to better predictions by the geothermal model 126 and enable more efficient drilling operations.

As disclosed, thermal conductivity properties of subsurface structures can be determined from cuttings are carried to surface by the return drilling mud (e.g., drilling fluid) and separated. At a high level, samples of cuttings can be collected at predefined intervals (e.g., every 100 feet or every 250 feet) or when the cuttings look different. Cores are then prepared by drying the cuttings and compressing using the hydrostatic pressure corresponding to the depth at they were drilled from. The cores can be prepared in real time on site or sent to a lab for thermal conductivity measurements. In some embodiments, the thermal conductivity values can be obtained (e.g., determined or measured) using a thermal conductivity meter 1450. The goal is to obtain the thermal conductivity data of cuttings either on the same day, or the next day, and then feed the data into the geo-field model 126, to obtain more accurate thermal performance prediction of the entire borefield.

FIGS. 15A to 15D provides a flowchart of a method 1500 for constructing geothermal fields, in accordance with some embodiments.

The method 1500 is performed at a system (e.g., a computer system, geothermal planning and optimization system 200) that includes one or more processors 202, and memory 206. The memory 206 stores one or more programs configured for execution by the one or more processors 202. In some embodiments, the operations shown in FIGS. 1, 2, 4A, 4B, 5A to 5E, 6A to 6C, 7, 8A to 8D, 9, 10, 11A to 11C, 12, 13, and 14 correspond to instructions stored in the memory 206 or other non-transitory computer-readable storage medium. The computer-readable storage medium may include a magnetic or optical disk storage device, solid state storage devices such as Flash memory, or other non-volatile memory device or devices. In some embodiments, the instructions stored on the computer-readable storage medium include one or more of: source code, assembly language code, object code, or other instruction format that is interpreted by one or more processors. Some operations in the method 1500 may be combined and/or the order of some operations may be changed.

Figure 15A:
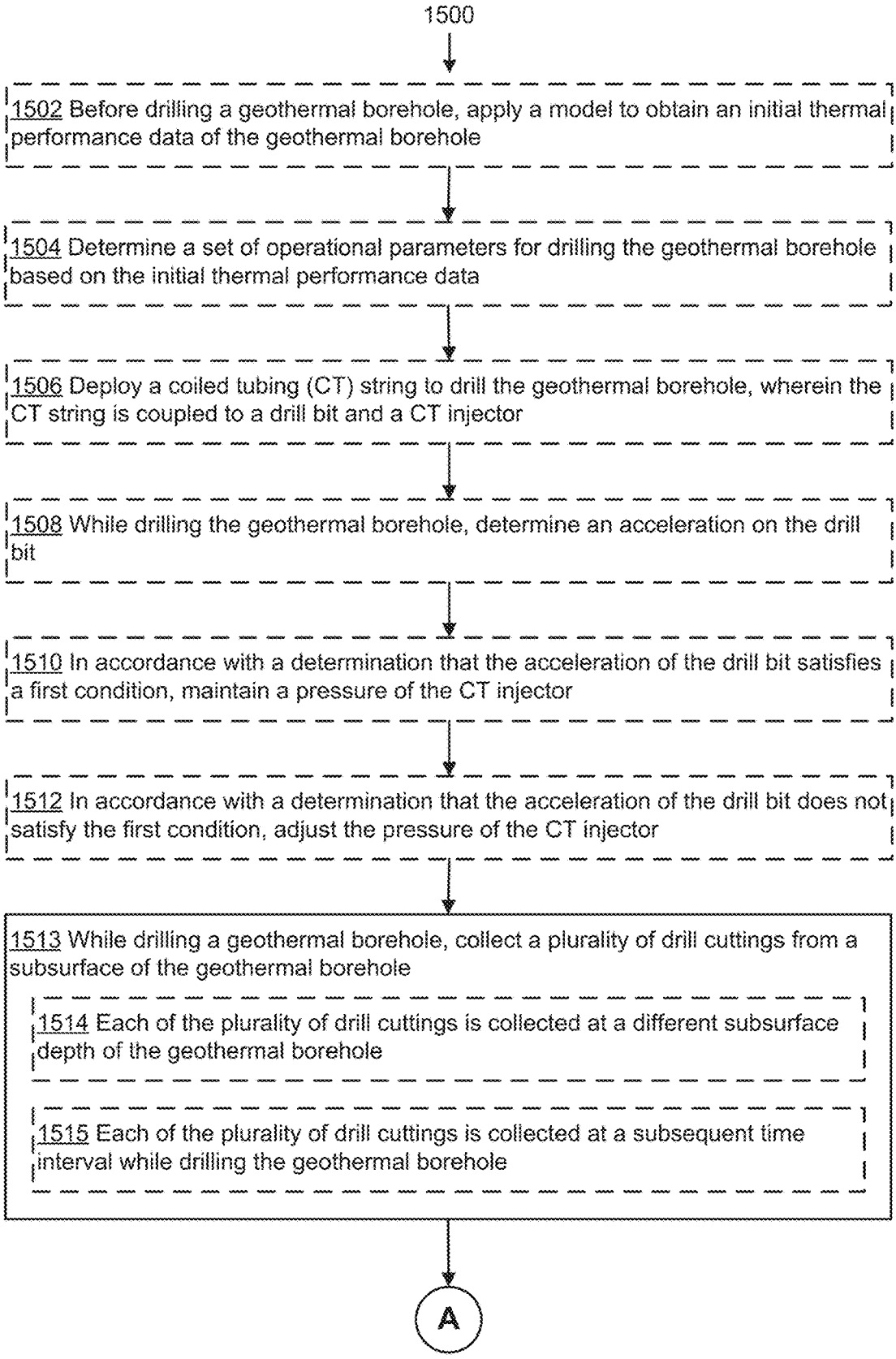
FIGS. 15A to 15D provide a flowchart of a method for constructing geothermal fields, in accordance with some embodiments.

Referring to FIG. 15A, in some embodiments, the method includes before drilling the geothermal borehole, applying (1502) a model (e.g., a geothermal model or model 126) to obtain an initial thermal performance data of the geothermal borehole. The method includes determining (1504) a set of operational parameters for drilling the geothermal borehole based on the initial thermal performance data.

For example, the set of operational parameters can include a size of the borehole, a depth or length of the borehole, and/or an angle/inclination of the borehole. In some embodiments, the set of operational parameters (and their corresponding values) allows the borehole to achieve the initial thermal performance data.

In some embodiments, the method includes deploying (1506) a coiled tubing (CT) string (e.g., CT 408, CT 818, CT 902, CT 1310, or CT 1320) to drill the geothermal borehole. The CT string is coupled to a drill bit (e.g., drill bit 502, drill bit 810, drill bit 908) and a CT injector (e.g., CT injector 410).

In some embodiments, the CT injector parameters can be adjusted by determining or monitoring an acceleration of the drill bit. For example, the method includes while drilling the geothermal borehole, determining (1508) an acceleration (or a force) on the drill bit (e.g., via a subsurface sensor such as an acceleration sensor or a velocity sensor). The method includes in accordance with a determination that the acceleration of the drill bit satisfies a first condition (e.g., the acceleration is not negative, or is positive), maintaining (1510) a pressure (or a pump rate) of the CT injector. The method includes, in accordance with a determination that the acceleration of the drill bit does not satisfy the first condition (e.g., the acceleration is negative, the drill bit is rotating more slowly), adjusting (1512) the pressure (or the pump rate) of the CT injector.

In some embodiments, thermal conductivity measurements of rocks can be used as a proxy for determining rock porosity. For example, a lower thermal conductivity value can indicate higher rock porosity (due to the presence of fluids inside the rocks) whereas a higher thermal conductivity value may be indicative of lower porosity.

For drilling, thermal conductivity is a proxy for rock strength: If the rock is harder, the CT injector pressure or pump rate needs to increase to drive the CT at a faster speed. If the rock is softer, the CT injector pressure or pump rate can be decreased to drive the CT into the subsurface at a lower speed.

The method includes while drilling a geothermal borehole, collecting (1513) (e.g., in real time, during the drilling) a plurality of drill cuttings (or a plurality of sets of drill cuttings) from a subsurface of the geothermal borehole. The drill cuttings comprise rocks/geological structures from the subsurface.

In some embodiments, each of the plurality of drill cuttings (or each set of drill cuttings) is collected (1514) at a different (e.g., predefined, known) subsurface depth of the geothermal borehole (e.g., every 50 feet, 100 feet, or 200 feet).

In some embodiments, each of the plurality of drill cuttings (or each set of drill cuttings) is collected (1515) at a subsequent time interval (or predefined time intervals, such as every 30 minutes or every hour) while drilling the geothermal borehole.

In some embodiments, the drill cuttings are collected when an appearance of the drill cuttings changes or when a type of the drill cuttings (e.g., a rock type corresponding to the drill cuttings) changes. For example, the drill cuttings can correspond to rock types such as limestone, sandstone, clay, and granite. Changes in drill cutting appearances and/or types can indicate changes in subsurface geological structure or rock type, and consequently changes in their thermal conductivity values.

Figure 15B:
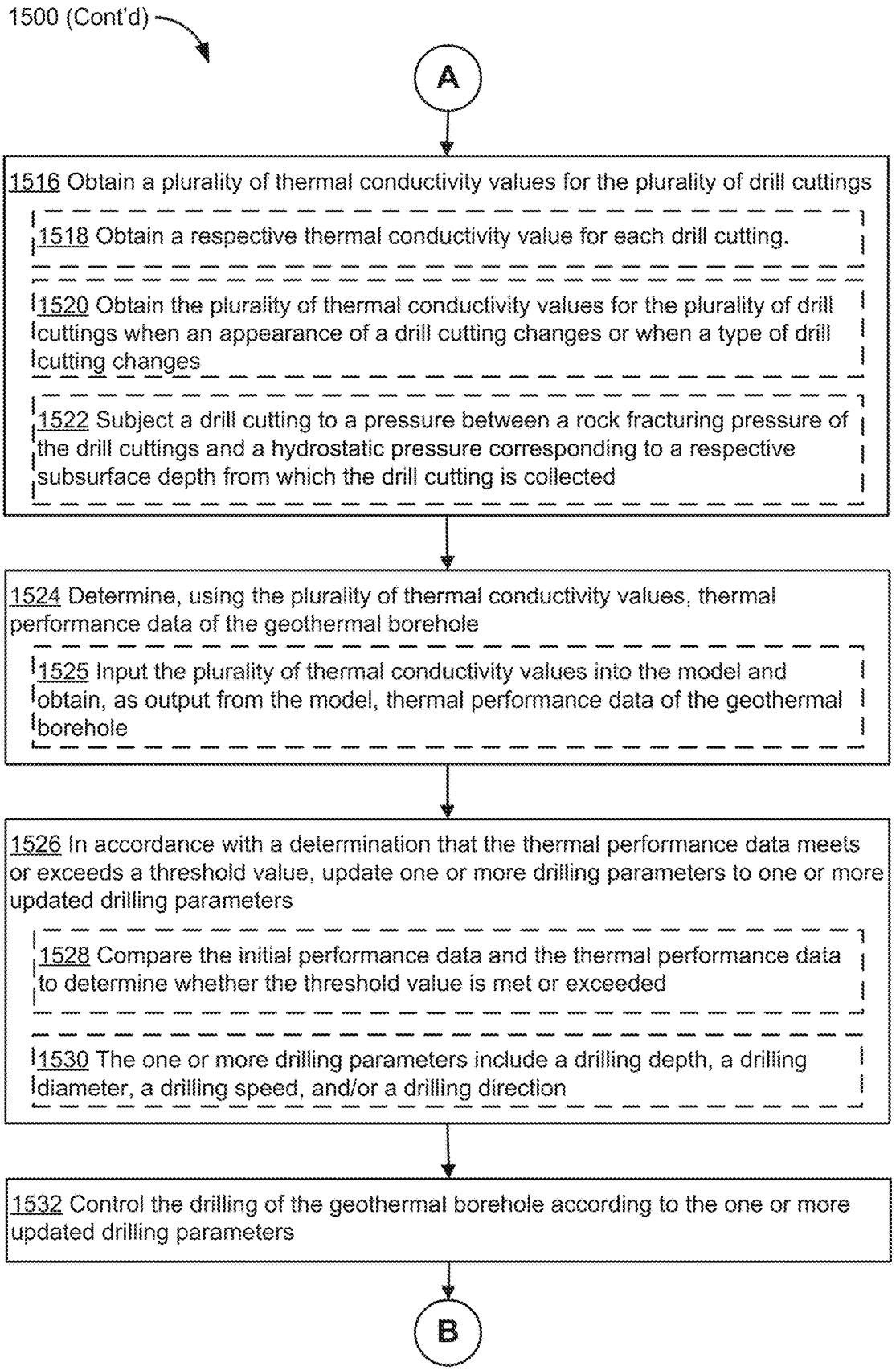

Referring now to FIG. 15B, the method includes obtaining (1516) a plurality of thermal conductivity value for the plurality of drill cuttings. For example, in some embodiments, the plurality of thermal conductivity values can be obtained (e.g., determined) at the geo-field construction site, via a thermal conductivity meter 1450 that is located on-site. In some embodiments, the plurality of thermal conductivity values can be obtained by sending the plurality of drill cuttings to a lab for measurements. In some embodiments, the goal is to obtain the thermal conductivity data of the cuttings within the duration of the geo-field construction (e.g., within the same day or the next day), and input the data in the model 126 to obtain site data that for optimizing the drilling parameters or operational parameters of a geo-loop to be installed in the constructed borehole. In some embodiments, the method includes obtaining (1518) a respective thermal conductivity value for each drill cutting of the plurality of drill cuttings.

In some embodiments, the plurality of thermal conductivity values for the plurality of drill cuttings are obtained (1520) when an appearance of a drill cuttings changes or when a type of drill cuttings changes.

In some embodiments, determining the respective conductivity value for each set of drill cuttings includes subjecting (1522) the respective set of drill cuttings to a hydrostatic pressure corresponding to a respective subsurface depth from which the respective set of drill cuttings are collected, so as to simulate the natural conditions that the rock was formed, and simulate the natural porosity of the rock before drilling.

The method includes determining (1524), using the plurality of thermal conductivity values, thermal performance data of the geothermal borehole.

In some embodiments, the plurality of thermal conductivity values are input into the model (e.g., geothermal model, model 126). The model generates the thermal performance data of the geothermal borehole according to the plurality of thermal conductivity values. For example, in some embodiments, the thermal performance data of the geothermal borehole includes a predicted temperature of a working fluid at an outlet of a geothermal loop that is constructed from the geothermal borehole. In some embodiments, the thermal performance data of the geothermal borehole includes a downhole temperature (i.e., the temperature at the bottom of the borehole, assuming that the temperature variation along the borehole is assumed linear), or the temperature along the borehole, or an outlet temperature of a geothermal loop constructed from the geothermal borehole.

The method includes, in accordance with a determination that the thermal performance data meets or exceeds a threshold value, updating (1526) (e.g., adjusting, modifying, changing) one or more drilling parameters to one or more updated drilling parameters.

For example, in some embodiments, the system 200 compares (1528) the initial performance data and the thermal performance data to determine whether the threshold value is met or exceeded. For instance, the system 200 may determine a difference between the thermal performance data and the initial thermal performance data of the geothermal borehole to determine whether the threshold value is met or exceeded (e.g., whether the difference meets or exceeds ±1%, ±2%, ±5%, ±10%, or ±15%).

In some embodiments, the one or more drilling parameters include (1530) a drilling depth, a drilling diameter, a drilling speed, or a drilling direction.

In some embodiments, the method includes controlling (1532) the drilling of the geothermal borehole according to the one or more updated drilling parameters.

Figure 15C:
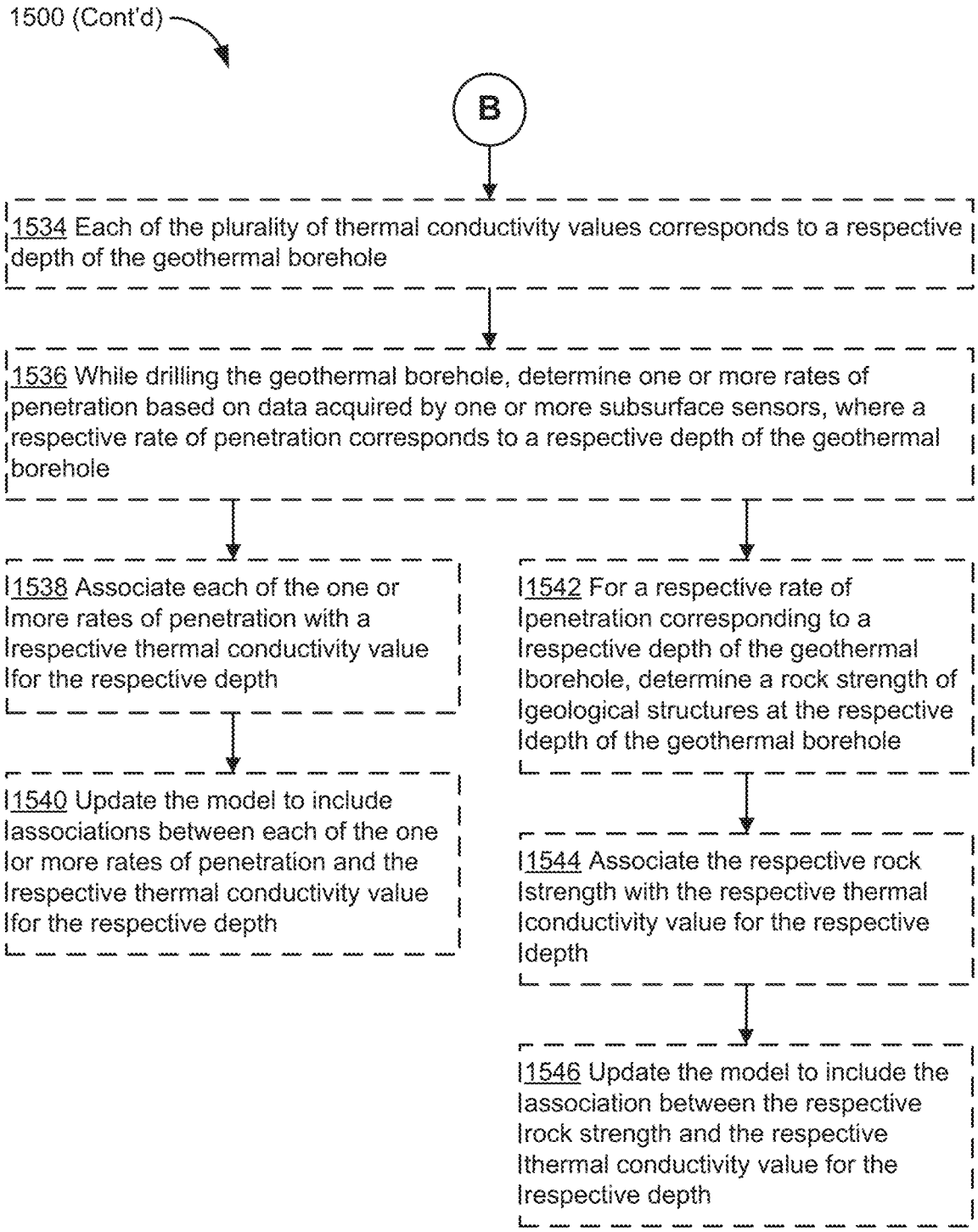

With continued reference to FIG. 15C, in some embodiments, each of the plurality of thermal conductivity values corresponds (1534) to a respective depth (e.g., in the subsurface) of the geothermal borehole. The method includes, while drilling the geothermal borehole, determining (1536) one or more rates of penetration based on data acquired by one or more subsurface sensors, where respective rate of penetration corresponds to a respective depth of the geothermal borehole.

In some embodiments, the method includes associating (1538) each of the one or more rates of penetration (ROP) with a respective thermal conductivity value for the respective depth, and updating (1540) the model to include associations (correlation) between each of the one or more rates of penetration and the respective thermal conductivity value for the respective depth.

In some embodiments, ROP refers to the time required to drill a predefined depth of the geothermal borehole (e.g., every 100 feet, or every 200 feet). ROP can have units of feet per hour or meters per hour. In some instances, the system tracks/monitors depth data and time, and determines ROP as depth/time, where the depth can be 50 feet, 100 feet, 150 feet, or 200 feet (within +/−5%).

In some embodiments, the predefined depth can be a depth (e.g., length) at which the pumping pressure and flow rate are pseudo-steady-state (e.g., 50 feet or 150 feet).

In some embodiments, the method includes determining a plurality of ROPs, each corresponding to a respective depth interval of the geothermal borehole (e.g., every 100 feet, every 200 feet, or every 500 feet). Each of the plurality of thermal conductivity values corresponds to a thermal conductivity value at a respective subsurface depth of the geothermal borehole. The method includes associating (e.g., correlating) the respective rate of penetration with the respective thermal conductivity value for the corresponding subsurface depth, and updating the model.

In some embodiments, thermal conductivity measurements of rocks can be used as a proxy for determining rock porosity. For example, a lower thermal conductivity value can indicate higher rock porosity (due to the presence of fluids inside the rocks) whereas a higher thermal conductivity value may be indicative of lower porosity.

In some embodiments, the method includes, for a respective rate of penetration corresponding to a respective depth of the geothermal borehole, determining (1542) a rock strength of geological structures at the respective depth of the geothermal borehole; and associating (1544) the respective rock strength with the respective thermal conductivity value for the respective depth. For example, in some embodiments, ROP can be defined using an empirical relationship such as $ROP=K\times W/(D\times S)$, where K is a constant that depends on the bit type and size, W is the weight on the drill bit (WOB), D is the drill bit diameter, and S is the rock strength.

In some embodiments, the method includes updating the model to include the association (correlation) between the respective rock strength and the respective thermal conductivity value for the respective depth.

In some embodiments, after the relationship between the rate of penetration and the thermal conductivity is established, the relationship can be utilized to optimize drilling parameters. Going back to the empirical relationship $ROP=K\times W/(D\times S)$ as an example, K and D cannot be changed as they are properties of the drill bit. In some embodiments, W and S can be adjusted by optimizing the drilling mud flow rate and injector pressure/speed (for W) and characterizing the rocks from thermal conductivity measurements (for S).

Figure 15D:
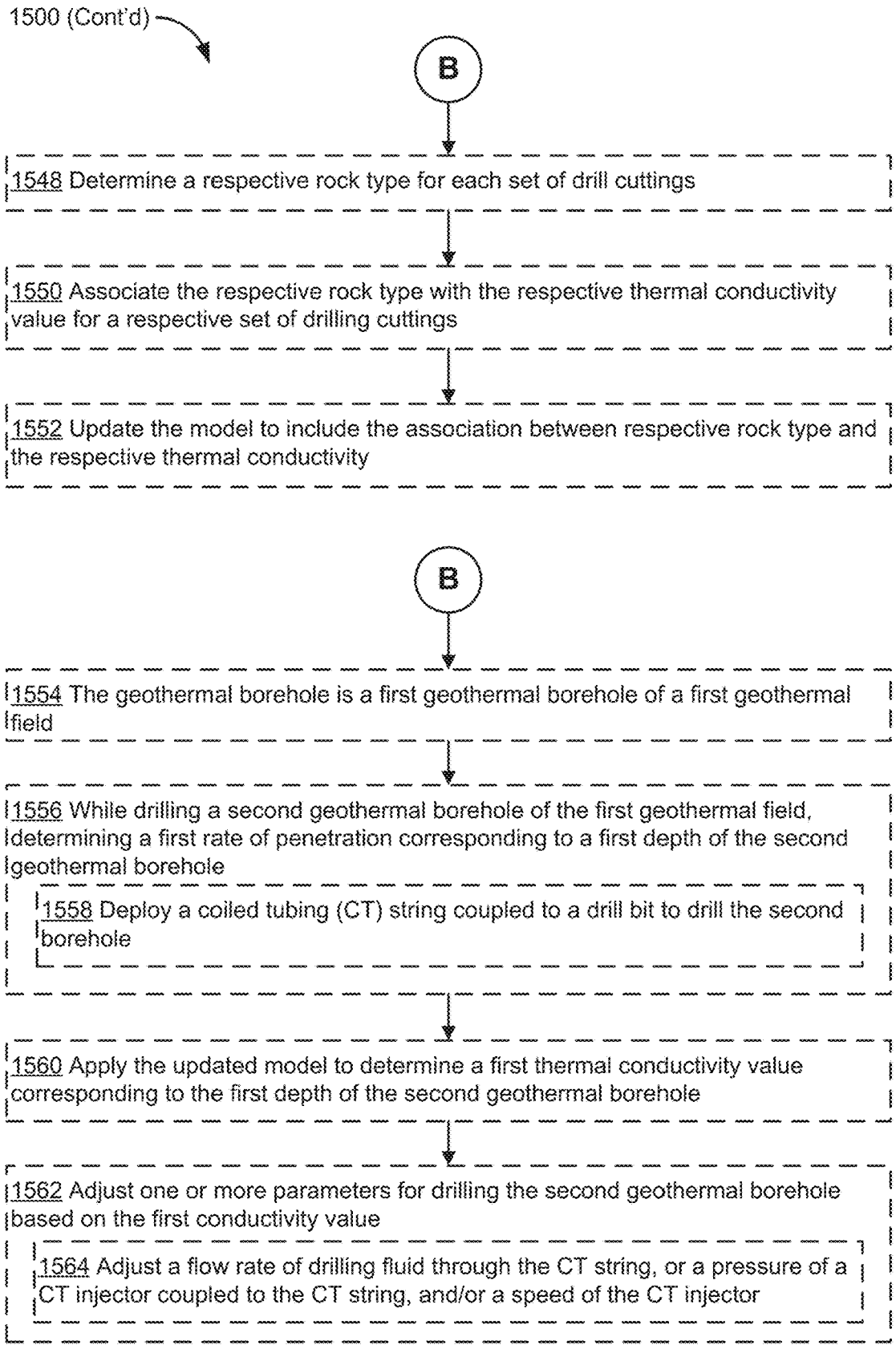

Referring to FIG. 15D, in some embodiments, the method includes determining (1548), for each of the plurality of drill cuttings, a respective rock type (or a dominant rock type). For example, the respective rock type can be determined by visually inspecting the drill cuttings to identify color(s), streaks, shape, or cleavage. In some embodiments, the respective rock type can be determined from hardness measurements, acidity measurements, or composition measurements. Examples of rock types can include limestone, sandstone, clay, slate, basalt, and granite. The method includes associating (1550) the respective rock type with the respective thermal conductivity value for the respective set of drilling cuttings, and updating (1552) the model to include the association between respective rock type and the respective thermal conductivity.

In some embodiments, the thermal conductivity values that are obtained can be used to optimize ROP. For example, in some embodiments, the geothermal borehole is (1554) a first geothermal borehole of a first geothermal field. The method includes while drilling a second geothermal borehole of the first geothermal field (e.g., the second geothermal borehole can be adjacent to, in the vicinity of the first geothermal borehole), determining (1556) a first rate of penetration corresponding to a first depth of the second geothermal borehole (based on data acquired by one or more subsurface sensors).

In some embodiments, drilling the second geothermal borehole includes deploying (1558) a coiled tubing (CT) string coupled to a drill bit.

In some embodiments, the method includes applying (1560) the updated model to determine a first thermal conductivity value corresponding to the first depth of the second geothermal borehole. The method includes adjusting (1562) one or more parameters for drilling the second geothermal borehole based on the first conductivity value (to optimize the rate of penetration).

In some embodiments, adjusting the one or more parameters includes adjusting (1564) one or more of: a flow rate of drilling fluid/mud through the CT string, or a pressure of a CT injector coupled to the CT string (that drives the CT into the subsurface), or a speed of the CT injector.

Now turning to some example embodiments:

(A1) In accordance with some embodiments, a system for constructing geothermal fields comprises a coiled tubing (CT) string, a power source (e.g., electrical power source, such as a battery or wired power cable), and an electrically activated bottomhole assembly (BHA) coupled to the CT string. The electrically activated BHA includes an electric motor and a drill bit. The system includes one or more processors and memory coupled to the one or more processors. The memory stores instructions that, when executed by the one or more processors, cause the system to: (i) deploy the CT string from a surface into a subsurface to drill (e.g., construct) a geothermal borehole; and (ii) during the drilling, (a) transfer electrical power from the power source to the electric motor via at least a first portion of the CT string; and (b) transfer electric current from the electric motor to the electric power source via an electrical conductor that is different from the at least the first portion of the CT string (e.g., so as to create a closed loop electric circuit).

(A2) In some embodiments of A1, the second electrical conductor is an electrically conductive cable that is different from the CT string.

(A3) In some embodiments of A1 or A2, the CT string is a concentric CT string comprising an inner portion (e.g., electrically conductive region 1322, an inner tube) surrounded by an outer portion (e.g., electrically conductive 1326, outer CT string, or an outer tube). The first portion of the CT string is the inner portion and the electrical conductor is the outer portion.

(A4) In some embodiments of any of A1-A3, the CT string is a concentric CT string comprising an inner portion e.g., inner region 1322, a cylindrical portion, an inner CT string) surrounded by an outer portion (e.g., outer region 1326, annular portion, outer CT string). The first portion of the CT string is the outer portion and the electrical conductor is the inner portion. For example, in some embodiments, the concentric CT string forms a closed loop electrical circuit whereby current is transferred from the power source to the electrical motor along the center of the concentric CT string and returns along the outer shell of the concentric CT string. In some embodiments, the concentric CT string forms a closed loop electrical circuit whereby current is transferred from the power source to the electrical motor along an outer wall of the concentric CT string and returns along center of the concentric CT string.

(A5) In some embodiments of A3 or A4, the inner portion and the outer portion are separated by an electrically insulating material (e.g., electrically insulating region 1324), so as to prevent short circuit between the electrically conductive region 1322 and the electrically conductive region 1326.

(A6) In some embodiments of any of A3-A5, the memory includes instructions that, when executed by the one or more processors, cause the system to: while drilling the geothermal borehole, (a) transfer drilling fluid from the surface to the subsurface through a space between the outer portion of the concentric CT string and the inner portion of the concentric CT string (e.g., space 1325) and (b) transfer the drilling fluid from the subsurface to the surface through a space of the electrical conductor (e.g., space 1321).

(A7) In some embodiments of any of A1-A6, the electric motor is a brushless motor.

(A8) In some embodiments of A7, a motor driver circuit of the electric motor is positioned in the electrically activated BHA.

(A9) In some embodiments of any of A1-A8, wherein the electric power source is a battery.

(A10) In some embodiments of A9, the battery is located within the CT string.

(A11) In some embodiments of any of A1-A10, wherein the power source located at the surface (e.g., above the ground).

(A12) In some embodiments of any of A1-A11, the power source is part of the electrically activated BHA.

(A13) In some embodiments of any of A1-A12, the power source is located at the subsurface during the drilling.

(A14) In some embodiments of any of A1-A13, the power source is a battery.

(A15) In some embodiments of any of A1-A14, the power source comprises a direct current (DC) power source.

(A16) In some embodiments of A15, the DC power source is converted (e.g., rectified) from an alternating current (AC) power line that is located on a surface (e.g., surface of the ground; the AC power line is not underground).

(A17) In some embodiments of any of A1-A16, during the drilling, the CT string transfers drilling fluid from the surface to the subsurface (e.g., downhole) or transfers the drilling fluid from the subsurface to the surface.

(A18) In some embodiments of any of A1-A17, the system further includes an electrically controlled (e.g., not hydraulically controlled) CT injector for driving the CT string from the surface into the subsurface.

(B1) In accordance with some embodiments, a system for constructing geothermal fields comprises a coiled tubing (CT) string and an electrical resistivity tomography (ERT) device coupled to the CT string. The ERT device includes a plurality of electrodes. The system includes one or more processors and memory coupled to the one or more processors. The memory stores instructions that, when executed by the one or more processors, cause the system to (a) deploy the CT string from a surface into a subsurface to drill (e.g., construct) a geothermal borehole; (b) obtain, in real time during the drilling, electrical resistivity data of the subsurface (e.g., electrical resistivity of the rocks and other subsurface geological data) via the plurality of electrodes of the ERT device; and (c) adjust, in real-time according to the obtained electrical resistivity data, an electrolytic conductivity of a drilling fluid that is pumped through the CT string (e.g., so as to improve a quality of the obtained electrical resistivity data).

(B2) In some embodiments of B1, adjusting the electrolytic conductivity of the drilling fluid includes adding or removing one or more electrolytes into the drilling fluid. For example, the electrolytic conductivity of the drilling fluid can be changed by adding or removing dissolved ions. The electrolytic conductivity of a fluid is determined by the concentration of charged particles, or electrolytes, dissolved in the drilling fluid. For example, adding potassium chloride (KCl) or sodium chloride (NaCl) to water increases the conductivity because the water molecules pull the potassium (or sodium) and chlorine ions apart, allowing them to float freely.)

(B3) In some embodiments of B1 or B2, adjusting the electrolytic conductivity of the drilling fluid includes adjusting a temperature of the drilling fluid. For example, a higher temperature enhances the solubility of electrolytes and hence the concentration of ions which results in increased electrolytic conduction. The solubility of electrolytes decreases at lower temperatures and hence the electrolytic conduction decreases.

(B4) In some embodiments of any of B1-B3, the electrical resistivity data comprises imaging data and the electrolytic conductivity of the drilling fluid is adjusted according to a contrast level (e.g., a relative contrast) between different geological structures in the subsurface. For example, the electrolytic conductivity of the drilling fluid is adjusted to enhance the level of contrast of the different substructures.

(B5) In some embodiments of any of B1-B4, the memory includes instructions that, when executed by the one or more processors, cause the system to detect, via the electrical resistivity data, presence of one or more obstacles (e.g., gas lines, water pipes, power lines) during the drilling.

(B6) In some embodiments of any of B1-B5, the system further includes a bottomhole assembly (BHA) that includes a downhole telemetry tool having a plurality of sensors and a drill bit. The memory includes instructions that, when executed by the one or more processors, cause the system to measure, in real-time during the drilling, subsurface (downhole) data via the plurality of sensors.

(B7) In some embodiments of B6, the ERT device is part of the BHA.

(B8) In some embodiments of B6 or B7, wherein the plurality of sensors includes a first subset of (e.g., one or more) sensors that are mounted on a flexible (e.g., bendable or foldable) electronics board. In some embodiments, in addition to sensors mounted on the flex electronics board, there are other sensors mounted elsewhere on the telemetry system. This is illustrated in, e.g., FIGS. 8C and 8D.

(B9) In some embodiments of B8, the downhole telemetry tool includes a battery (e.g., for powering the telemetry tool, or as a backup power source to the telemetry tool); and the flexible electronics board surrounds (e.g., physically wraps around, physically coupled, bends around) at least a portion of the battery power source.

(B10) In some embodiments of B8 or B9, the first subset of sensors includes an azimuth sensor.

(B11) In some embodiments of any of B8-B10, the first subset of sensors includes an acceleration sensor.

(B12) In some embodiments of B11, the system includes a CT injector (e.g., hydraulically controlled or electrically controlled) for driving the CT string into the subsurface. The memory includes instructions that, when executed by the one or more processors, cause the system to, based on at least data from the acceleration sensor: (i) determine a weight of the CT string below the injector (e.g., with drilling fluid inside); (ii) determine a weight of the BHA; and (iii) determine an axial force at the drill bit based on the weight of the CT string below the injector and the weight of the BHA (e.g., based on force equals acceleration times weight).

(B13) In some embodiments of any of B1-B12, the memory includes instructions that, when executed by the one or more processors, cause the system to: after drilling the geothermal borehole, constructing a geothermal loop based on the drilled borehole, including installing a tracer line in the subsurface with the geothermal loop. The tracer line can be an electrically conductive wire that is clamped along a geo-loop and buried with the geo-loop, so that the borehole can be identified by utility companies (if needed)

(C1) In accordance with some embodiments, a method for constructing geothermal fields includes, while drilling a geothermal borehole, collecting (e.g., in real time during the drilling) a plurality of drill cuttings from a subsurface of the geothermal borehole. The method includes obtaining a plurality of thermal conductivity values for the plurality of drill cuttings. The method includes determining, using the plurality of thermal conductivity values, thermal performance data of the geothermal borehole. The method includes, in accordance with a determination that the thermal performance data of the geothermal borehole meets or exceeds a threshold value: updating, according to the thermal performance data, one or more drilling parameters to one or more updated drilling parameters; and controlling the drilling of the geothermal borehole according to the one or more updated drilling parameters.

(C2) In some embodiments of C1, each of the plurality of drill cuttings is collected at a different subsurface depth of the geothermal borehole.

(C3) In some embodiments of C1 or C2, each of the plurality of drill cuttings is collected at a subsequent time interval while drilling the geothermal borehole.

(C4) In some embodiments of any of C1-C3, the method includes obtaining the plurality of thermal conductivity values for the plurality of drill cuttings when an appearance of a drill cutting changes or when a type of drill cutting changes.

(C5) In some embodiments of any of C1-C4, obtaining the plurality of thermal conductivity values for the plurality of drill cuttings includes subjecting a drill cutting to a pressure between a rock fracturing pressure of the drill cutting and a hydrostatic pressure corresponding to a respective subsurface depth from which the drill cutting is collected.

(C6) In some embodiments of any of C1-C5, updating the one or more drilling parameters includes updating one or more of: a drilling depth, a drilling diameter, a drilling speed, or a drilling direction.

(C7) In some embodiments of any of C1-C6, each of the plurality of thermal conductivity values corresponds to a respective depth of the geothermal borehole. The method further includes, while drilling the geothermal borehole, determining one or more rates of penetration based on data acquired by one or more subsurface sensors, where a respective rate of penetration corresponds to a respective depth of the geothermal borehole. The method includes associating each of the one or more rates of penetration with a respective thermal conductivity value for the respective depth.

(C8) In some embodiments of C7, the method further includes updating the model to include associations between each of the one or more rates of penetration and the respective thermal conductivity value for the respective depth.

(C9) In some embodiments of C8, the geothermal borehole is a first geothermal borehole of a first geothermal field. The method includes, while drilling a second geothermal borehole of the first geothermal field, (i) determining a first rate of penetration corresponding to a first depth of the second geothermal borehole, (ii) applying the updated model to determine a first thermal conductivity value corresponding to the first depth of the second geothermal borehole; and (iii) adjusting one or more parameters for drilling the second geothermal borehole based on the first thermal conductivity value to optimize the rate of penetration.

(C10) In some embodiments of C9, drilling the second geothermal borehole includes deploying a coiled tubing (CT) string coupled to a drill bit.

(C11) In some embodiments of C9 or C10, adjusting the one or more parameters includes adjusting one or more of: a flow rate of drilling fluid through the CT string; or a pressure of a CT injector coupled to the CT string, or a speed of the CT injector.

(C12) In some embodiments of any of C7-C11, the method further includes, for a respective rate of penetration corresponding to a respective depth of the geothermal borehole: (i) determining a rock strength of geological structures at the respective depth of the geothermal borehole; and (ii) associating the respective rock strength with the respective thermal conductivity value for the respective depth.

(C13) In some embodiments of C12, the method further includes updating a model to include the association between the respective rock strength and the respective thermal conductivity value for the respective depth.

(C14) In some embodiments of any of C1-C13, the method further includes determining, for each of the plurality of drill cuttings, a respective rock type; and associating the respective rock type with the respective thermal conductivity value for the respective drill cutting.

(C15) In some embodiments of C14, the method further includes updating a model to include the association between respective rock type and the respective thermal conductivity.

(C16) In some embodiments of any of C1-C15, the method further includes, before drilling the geothermal borehole, applying a model to obtain initial thermal performance data of the geothermal borehole; and determining a set of operational parameters for drilling the geothermal borehole based on the initial thermal performance data. In some embodiments, the set of operational parameters includes a size of the geothermal borehole, a depth or length of the geothermal borehole, and/or an angle/inclination of the geothermal borehole.

(C17) In some embodiments of any of C1-C16, the method further includes deploying a coiled tubing (CT) string to drill the geothermal borehole, wherein the CT string is coupled to a drill bit and a CT injector.

(C18) In some embodiments of C17, the method further includes, while drilling the geothermal borehole, determining an acceleration (or a force) on the drill bit. In accordance with a determination that the acceleration of the drill bit satisfies a first condition, maintaining a pressure (or a pump rate) of the CT injector; and in accordance with a determination that the acceleration of the drill bit does not satisfy the first condition adjusting the pressure (or the pump rate) of the CT injector.

(D1) In accordance with some embodiments, a system for constructing geothermal fields, comprises one or more processors and memory. The memory stores one or more programs for performing the method of any of C1-C18.

(E1) In accordance with some embodiments, a non-transitory computer readable storage medium stores one or more programs that, when execution by a system having one or more processors, and memory, cause the system to perform the method of any of C1-C18.

The terminology used in the description of the invention herein is for the purpose of describing particular implementations only and is not intended to be limiting of the invention. As used in the description of the invention and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

As used herein, the phrase "based on" does not mean "based only on," unless expressly specified otherwise. In other words, the phrase "based on" describes both "based only on" and "based at least on."

As used herein, the term "exemplary" means "serving as an example, instance, or illustration," and does not necessarily indicate any preference or superiority of the example over any other configurations or implementations.

As used herein, the term "and/or" encompasses any combination of listed elements. For example, "A, B, and/or C" includes the following sets of elements: A only, B only, C only, A and B without C, A and C without B, B and C without A, and a combination of all three elements, A, B, and C.

The foregoing description, for purpose of explanation, has been described with reference to specific implementations. However, the illustrative discussions above are not intended to be exhaustive or to limit the invention to the precise forms disclosed. Many modifications and variations are possible in view of the above teachings. The implementations were chosen and described in order to best explain the principles of the invention and its practical applications, to thereby enable others skilled in the art to best utilize the invention and various implementations with various modifications as are suited to the particular use contemplated.

What is claimed is:

1. A method for constructing geothermal fields, comprising:

while drilling a geothermal borehole, collecting a plurality of drill cuttings from a subsurface of the geothermal borehole;

obtaining a plurality of thermal conductivity values for the plurality of drill cuttings;

determining, using the plurality of thermal conductivity values, thermal performance data of the geothermal borehole; and in accordance with a determination that the thermal performance data of the geothermal borehole meets or exceeds a threshold value:

updating, according to the thermal performance data, one or more drilling parameters to one or more updated drilling parameters; and controlling the drilling of the geothermal borehole according to the one or more updated drilling parameters.

2. The method of claim 1, wherein each of the plurality of drill cuttings is collected at a different subsurface depth of the geothermal borehole.

3. The method of claim 1, wherein each of the plurality of drill cuttings is collected at a subsequent time interval while drilling the geothermal borehole.

4. The method of claim 1, further comprising:

obtaining the plurality of thermal conductivity values for the plurality of drill cuttings when an appearance of a drill cutting changes or when a type of drill cutting changes.

5. The method of claim 1, wherein obtaining the plurality of thermal conductivity values for the plurality of drill cuttings includes:

subjecting a drill cutting to a pressure between a rock fracturing pressure of the drill cutting and a hydrostatic pressure corresponding to a respective subsurface depth from which the drill cutting is collected.

6. The method of claim 1, wherein updating the one or more drilling parameters includes updating one or more of:

a drilling depth;

a drilling diameter;

a drilling speed; or a drilling direction.

7. The method of claim 1, wherein:

each of the plurality of thermal conductivity values corresponds to a respective depth of the geothermal borehole; and the method further comprises:

while drilling the geothermal borehole, determining one or more rates of penetration based on data acquired by one or more subsurface sensors, wherein a respective rate of penetration of the one or more rates of penetration corresponds to a respective depth of the geothermal borehole; and associating each of the one or more rates of penetration with a respective thermal conductivity value for the respective depth.

8. The method of claim 7, further comprising:

updating a model to include associations between each of the one or more rates of penetration and the respective thermal conductivity value for the respective depth.

9. The method of claim 8, wherein:

the geothermal borehole is a first geothermal borehole of a first geothermal field; and the method includes:

while drilling a second geothermal borehole of the first geothermal field, determining a first rate of penetration corresponding to a first depth of the second geothermal borehole;

applying the updated model to determine a first thermal conductivity value corresponding to the first depth of the second geothermal borehole; and adjusting one or more parameters for drilling the second geothermal borehole based on the first thermal conductivity value.

10. The method of claim 9, wherein drilling the second geothermal borehole includes deploying a coiled tubing (CT) string coupled to a drill bit.

11. The method of claim 10, wherein adjusting the one or more parameters includes adjusting one or more of:

a flow rate of drilling fluid through the CT string; or a pressure of a CT injector coupled to the CT string; or a speed of the CT injector.

12. The method of claim 7, further comprising:

for a respective rate of penetration corresponding to a respective depth of the geothermal borehole:

determining a rock strength of geological structures at the respective depth of the geothermal borehole; and associating the respective rock strength with the respective thermal conductivity value for the respective depth.

13. The method of claim 12, further comprising:

updating a model to include the association between the respective rock strength and the respective thermal conductivity value for the respective depth.

14. The method of claim 1, further comprising:

determining, for each of the plurality of drill cuttings, a respective rock type; and associating the respective rock type with the respective thermal conductivity value for a respective drill cutting.

15. The method of claim 14, further comprising:

updating a model to include the association between respective rock type and the respective thermal conductivity.

16. The method of claim 1, further comprising:

before drilling the geothermal borehole:

applying a model to obtain initial thermal performance data of the geothermal borehole; and determining a set of operational parameters for drilling the geothermal borehole based on the initial thermal performance data.

17. The method of claim 1, further comprising:

deploying a coiled tubing (CT) string to drill the geothermal borehole, wherein the CT string is coupled to a drill bit and a CT injector.

18. The method of claim 17, further comprising:

while drilling the geothermal borehole, determining an acceleration on the drill bit;

in accordance with a determination that the acceleration of the drill bit satisfies a first condition, maintaining a pressure of the CT injector; and in accordance with a determination that the acceleration of the drill bit does not satisfy the first condition, adjusting the pressure of the CT injector.

19. A system for constructing geothermal fields, comprising:

one or more processors; and memory, wherein the memory stores one or more programs configured for execution by the one or more processors, and the one or more programs including instructions for:

while drilling a geothermal borehole, collecting a plurality of drill cuttings from a subsurface of the geothermal borehole;

obtaining a plurality of thermal conductivity values for the plurality of drill cuttings;

determining, using the plurality of thermal conductivity values, thermal performance data of the geothermal borehole; and in accordance with a determination that the thermal performance data of the geothermal borehole meets or exceeds a threshold value:

updating, according to the thermal performance data, one or more drilling parameters to one or more updated drilling parameters; and controlling the drilling of the geothermal borehole according to the one or more updated drilling parameters.

20. A non-transitory computer readable storage medium storing one or more programs configured for execution by a computer system having one or more processors, and memory, the one or more programs comprising instructions for:

while drilling a geothermal borehole, collecting a plurality of drill cuttings from a subsurface of the geothermal borehole;

obtaining a plurality of thermal conductivity values for the plurality of drill cuttings;

determining, using the plurality of thermal conductivity values, thermal performance data of the geothermal borehole; and in accordance with a determination that the thermal performance data meets or exceeds a threshold value:

updating, according to the thermal performance data, one or more drilling parameters to one or more updated drilling parameters; and controlling the drilling of the geothermal borehole according to the one or more updated drilling parameters.

* * * * *